US008011602B2

(12) United States Patent
Coppersmith

(10) Patent No.: US 8,011,602 B2
(45) Date of Patent: Sep. 6, 2011

(54) OSCILLATING SPRINKLER THAT AUTOMATICALLY PRODUCES A RECTANGULAR WATER DISTRIBUTION PATTERN

(76) Inventor: Eldon Coppersmith, Lakewood, CO (US)

( * ) Notice: Subject to any disclaimer, the term of this patent is extended or adjusted under 35 U.S.C. 154(b) by 222 days.

(21) Appl. No.: 12/192,689

(22) Filed: Aug. 15, 2008

(65) Prior Publication Data

US 2010/0038444 A1 Feb. 18, 2010

(51) Int. Cl.

| | |
|---|---|
| ***B05B 17/04*** | (2006.01) |
| ***B05B 3/00*** | (2006.01) |
| ***B05B 3/08*** | (2006.01) |
| ***B05B 3/16*** | (2006.01) |
| ***B05B 1/20*** | (2006.01) |

(52) U.S. Cl. ..... 239/11; 239/98; 239/210; 239/232; 239/236; 239/242; 239/248; 239/566; 239/DIG. 1

(58) Field of Classification Search ..... 239/11, 239/97, 98, 210, 231, 232, 236, 237, 240, 239/242, 246, 247, 248, 263, 381, 394, 566, 239/587.5, DIG. 1, 436, 437, 553, 562, 563, 239/553.3

See application file for complete search history.

(56) References Cited

U.S. PATENT DOCUMENTS

| | | | | |
|---|---|---|---|---|
| 3,647,140 | A * | 3/1972 | Perrot et al. | 239/242 |
| 5,305,956 | A * | 4/1994 | Wang | 239/242 |
| 5,350,115 | A * | 9/1994 | Burnworth et al. | 239/242 |
| 5,562,247 | A | 10/1996 | Roman | |
| 5,628,458 | A | 5/1997 | Kuo | |
| 5,657,928 | A | 8/1997 | Jian | |
| 6,062,490 | A | 5/2000 | Katzer et al. | |
| 6,135,356 | A | 10/2000 | Mitzlaff et al. | |
| 6,478,241 | B1 | 11/2002 | Guo | |
| 6,736,340 | B1 | 5/2004 | Wang | |
| 7,624,934 | B2 * | 12/2009 | Breedlove et al. | 239/242 |
| 2002/0092931 | A1 | 7/2002 | Coote | |
| 2006/0249595 | A1 * | 11/2006 | Lipscomb et al. | 239/242 |

FOREIGN PATENT DOCUMENTS

CA 2266247 A1 3/1999

* cited by examiner

*Primary Examiner* — Len Tran
*Assistant Examiner* — Ryan Reis
(74) *Attorney, Agent, or Firm* — Kilpatrick Townsend & Stockton LLP

(57) ABSTRACT

Many areas watered by prior art oscillating sprinklers are substantially rectangular. However, prior art oscillating sprinklers typically produce generally or substantially elliptical water distribution patterns. This geometric incompatibility causes problems and inefficiencies. Embodiments of the current invention include an oscillating sprinkler that automatically produces a substantially rectangular water distribution pattern. The substantially rectangular water distribution pattern may be produced by automatically controlling the distance from the sprinkler that streams of water travel before impacting the ground. This is accomplished by automatically and sequentially opening and closing and/or restricting flow to select nozzles at select points and within select portions of the oscillation cycle. A current invention oscillating sprinkler may reduce waste water, may reduce run-off waste water, and may automatically provide water to the corner areas of typical substantially rectangular areas to be watered.

16 Claims, 33 Drawing Sheets

CURRENT INVENTION

CURRENT INVENTION

CURRENT INVENTION

OSCILLATING SPRINKLER THAT AUTOMATICALLY PRODUCES A RECTANGULAR WATER DISTRIBUTION PATTERN

BACKGROUND OF THE INVENTION

This invention generally relates to outdoor sprinklers and portable watering systems.

Most houses and other residential buildings, especially in the U.S., are surrounded by areas of lawns, gardens, flowers, bushes, and trees, often including a front yard and a back yard. Many of these areas are generally rectangularly-shaped and are often bordered by houses, fences, driveways, streets, and sidewalks, which form generally straight lines and right angles.

Many people's choice of the type of sprinkler used to water these areas is the common oscillating sprinkler. These are inexpensive and versatile, and water more square feet of area than other types of sprinklers.

Water is supplied to a prior art oscillating sprinkler from a standard faucet and a standard garden hose. These sprinklers typically consist of a base structure on which is mounted a water motor and an oscillating tube with a plurality of nozzles. The tube oscillates back and forth along its longitudinal axis by way of the water motor powered by the flow of water from the faucet and hose. This oscillation directs the spray back and forth in opposite directions. In order to water areas wider than the length of the oscillating tube, directional spray must be produced, so that for example, an oscillating tube twelve inches in length may typically produce a water distribution pattern for example, forty to fifty feet in width at the widest point of its generally elliptical water distribution pattern. Directional spray is produced either by using a curved tube as in U.S. Pat. No. 4,721,248, or else by placing the nozzles at longitudinally outward angles along a straight tube, as in U.S. Pat. No. 6,062,490.

There may be problems and inefficiencies with the use of prior art oscillating sprinklers because the directional spray may impact the ground at relatively great distances widthwise when the oscillating tube is in the vertical position, then may impact the ground at progressively lesser distances widthwise as the oscillating tube rotates toward the right or left horizontal-most oscillating position. This may produce the classic generally elliptical water distribution pattern which is convexly curved at both ends and on both sides. As in FIGS. 1*a, b*, and *c*, no matter where the prior art oscillating sprinkler 21 is located within a substantially rectangular area to be watered 22, the generally elliptical water distribution pattern 23 may be geometrically incompatible. If the prior art oscillating sprinkler is located where the water will reach the corners Y, then much of the water may fall outside of the area as waste water and/or run-off waste water X. If it falls on surfaces such as sidewalks, driveways, or streets, it may become run-off waste water which may carry pollutants such as fertilizers and herbicides into streams and lakes, etc. Waste water is an ethical and environmental problem in many areas of the U.S. and the world where there are fresh water shortages. Many cities may impose fines for wasting water. Alternatively, if the sprinkler is located where it will not produce waste water and/or run-off waste water X, then the corners Y may not receive water. It may be very time-consuming and aggravating to somehow provide water to all of the corners Y separately.

Conversely, as in FIGS. 1*d, e*, and *f*, a current invention oscillating sprinkler 24 may produce a substantially rectangular water distribution pattern 25 substantially geometrically compatible with a typical substantially rectangular area to be watered 22, and may resolve many problems and inefficiencies of prior art oscillating sprinklers. By appropriately adjusting the flow from the faucet, appropriately locating the sprinkler, and optionally engaging or disengaging adjustable stops on the oscillation mechanism, a substantially rectangular area may be watered with a current invention sprinkler efficiently, and with minimal waste water and/or run-off waste water X, and the corners Y may be efficiently and automatically watered. Even the L-shaped area of FIG. 1*f*, including its corners Y, may be watered with minimal waste water and/or run-off waste water X by relocating a current invention sprinkler only one time.

By selectively engaging or disengaging adjustable stops on the oscillation mechanism of a prior art oscillating sprinkler, a water distribution pattern generally shaped like an ellipse, or the right, left, or center section of an ellipse may be produced, also, manual adjustments may widen or elongate the generally elliptical water distribution pattern—but a prior art oscillating sprinkler simply may not be designed to produce a substantially rectangular water distribution pattern.

A current invention oscillating sprinkler may reduce waste water and/or run-off waste water X, and may efficiently and automatically provide water to the corners Y of typical substantially rectangular areas to be watered 22.

ALPHANUMERICAL REFERENCES

Figure 1A:
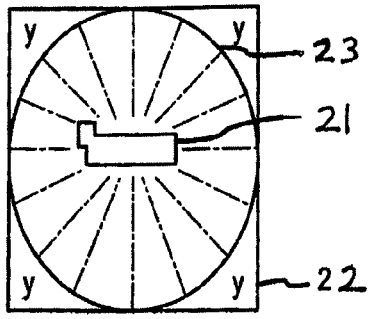
PRIOR ART FIG.1a
FIGS. 1*a, b*, and *c* are exemplary top views of typical substantially rectangular areas to be watered and generally elliptical water distribution patterns typically produced by prior art oscillating sprinklers.
Figure 1D:
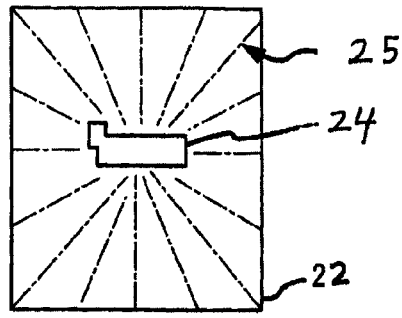
FIGS. 1*d, e*, and *f* are exemplary top views of typical substantially rectangular areas to be watered and substantially rectangular water distribution patterns that may be produced by a current invention oscillating sprinkler.
Figure 1B:
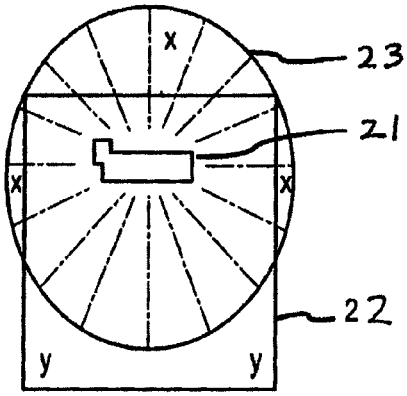
PRIOR ART FIG.1b
Figure 1E:
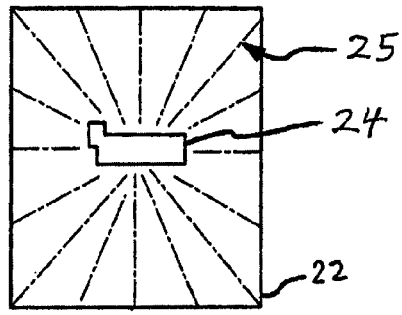
Figure 1C:
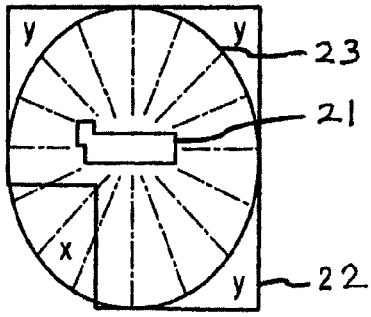
PRIOR ART FIG.1c
Figure 1F:
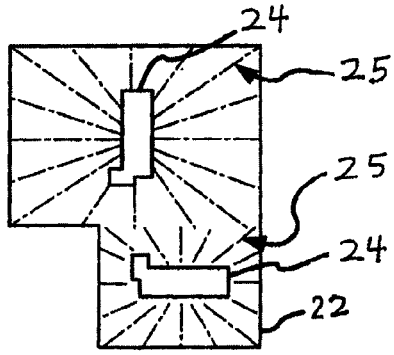

X Waste water and/or run-off waste water
Y Corner of typical substantially rectangular area to be watered
21 Prior art oscillating sprinkler
22 Typical substantially rectangular area to be watered
23 Generally elliptical water distribution pattern typical of prior art oscillating sprinkler
24 Current invention oscillating sprinkler
25 Substantially rectangular water distribution pattern typical of current invention oscillating sprinkler
30 Base structure
34 Oscillation mechanism with adjustable stops
38 Oscillating tube water supply opening
42 Oscillating tube
46 Nozzle
50 Relatively large "three dimensional" nozzle inlet opening
52 Nozzle outlet opening
54 Proximal end of oscillating tube and/or stationary regulatory insert
58 Distal end of oscillating tube and/or stationary regulatory insert
62 Longitudinal center point of oscillating tube and/or stationary regulatory insert
66 Stationary regulatory insert
70 Closed area of stationary regulatory insert
74 Open area of stationary regulatory insert
78 "O" ring
80 Longitudinally-oriented contoured open area
81 Longitudinally-oriented stepped open area
82 Flange functioning as a closed area of stationary regulatory insert
84 Notch functioning as an open area of stationary regulatory insert
86 Contoured end of flange functioning as a closed area of stationary regulatory insert
88 Slot functioning as an open area of stationary regulatory insert
90 Inter-flange extension functioning as a closed area of stationary regulatory insert
92 Protrusion functioning as a closed area of stationary regulatory insert
94 Tab functioning as a closed area of stationary regulatory insert
96 Stabilizing rings

Terminology

Subjunctive words such as "may be," "may restrict," and "may produce" are not meant to be construed as limiting, but rather are meant to be generally interchangeable with their corresponding indicative word forms such as "is," "restricts," and "produces," for example, and vice-versa.

As used herein the term "oscillate" refers to generally rotational movement about an axis that alternates between clockwise rotation and counterclockwise rotation back and forth along an arc. An "oscillating sprinkler" as used herein is a sprinkler comprising a plurality of nozzles that are disposed on a tube that oscillates relative to an axis to spray water (or other fluid) radially.

The term "or" as used in this specification and the appending claims is not meant to be exclusive; rather the term is inclusive meaning "either or both".

References in this specification to "one embodiment", "an embodiment", "a preferred embodiment", "an alternative embodiment", "embodiments", "variations", "a variation" and similar phrases means that a particular feature, structure, or characteristic described in connection with the embodiment(s) or variation(s) is included in at least an embodiment or variation of the invention. The appearances of the phrase "in one embodiment" or "in one variation" in various places in the specification are not necessarily all referring to the same embodiment or variation.

Directional and/or relationary terms such as, but not limited to, left, right, nadir, apex, top, bottom, vertical, horizontal, back, front, and lateral are relative to each other and are dependent on the specific orientation of an applicable element or article, and are used accordingly to aid in the description of the various embodiments and are not necessarily intended to be construed as limiting.

The term "area" may refer to a region, portion, part, or location, or may refer to a measurement of square feet, square inches, square millimeters, etc.

DETAILED DESCRIPTION OF THE INVENTION

The aforementioned problems and inefficiencies of the generally elliptical water distribution pattern typically produced by prior art oscillating sprinklers may be eliminated by a current invention oscillating sprinkler.

Experiments regarding a current invention oscillating sprinkler have shown that the widthwise and lengthwise boundaries are substantially rectilinear, and the water distribution pattern is substantially rectangular, whether produced with relatively low, medium, or high water pressures—that is, with the flow of water from the faucet adjusted relatively low, medium, or high. Adjusting the flow from the faucet may adjust the overall size, but generally not the shape of the substantially rectangular water distribution pattern.

One method of using a current invention sprinkler is to place the sprinkler in the center of the area to be watered and then to adjust the flow from the faucet so the size of the water distribution pattern is compatible with the size of the area to be watered. Alternatively, the sprinkler may be placed at an edge of the area, in which case adjustable stops on the oscillation mechanism may be engaged, causing the oscillating tube to oscillate between the vertical position and only one of the horizontal-most oscillating positions. Efficiency is available to the user by appropriately locating the sprinkler within the area to be watered, appropriately directionally orienting the sprinkler, engaging or disengaging adjustable stops on the oscillation mechanism, and appropriately adjusting the rate of flow of water from the faucet. By selectively engaging adjustable stops on the oscillation mechanism of a current invention sprinkler, a water distribution pattern shaped substantially like the right, left, or center section of a rectangle may be produced. Any of these sections may be substantially rectangular. Furthermore, the oscillation mechanism may be disconnected or otherwise adjusted causing the oscillating tube to remain in a substantially fixed position. A current invention sprinkler may thereby be used to water a substantially rectilinear area such as a row of flowers or a row of bushes, with no oscillation involved.

It is to be appreciated that conditions such as fluctuations in the water flow and pressure from the water faucet, and fluctuations in wind speed or direction during the time period that a sprinkler is in use may affect the water distribution pattern. However, a current invention oscillating sprinkler may be generally more capable of efficiently watering a substantially rectangular area than are prior art oscillating sprinklers.

The current invention sprinkler typically uses a water motor to facilitate the oscillation motion. For simplicity, the water motor has been omitted from the drawings, but it may be appreciated by one skilled in the art that some sort of motor is nonetheless required.

The current invention sprinkler comprises a water motor, a base structure 30, an oscillation mechanism with adjustable stops 34, an oscillating tube water supply opening 38, a stationary regulatory insert 66, an oscillating tube 42, and a plurality of nozzles 46 with relatively large "three dimensional" nozzle inlet openings 50, and nozzle outlet openings 52. The motor is connected to the oscillation mechanism with adjustable stops 34, which is connected to the oscillating tube 42. The oscillating tube water supply opening 38 is typically located at the proximal end 54 of the oscillating tube 42. The stationary regulatory insert 66 and the oscillating tube comprise a proximal end 54, a distal end 58, and a longitudinal center point 62.

Sections 54 and 58 are mirror images of each other and the stationary regulatory insert and the oscillating tube are symmetrical.

The oscillating tube 42 is cylindrically shaped and has a constant inside diameter around its longitudinal axis throughout its length. The inside diameter of the oscillating tube is minimally greater than the outside diameter of the stationary regulatory insert 66. The oscillating tube 42 completely encloses the stationary regulatory insert with a relatively very small space between the two. The oscillating tube 42 is sealed at the distal end, thus water exits the sprinkler out of the nozzle outlet openings 52, only.

Except for the nozzle 46 located at the longitudinal center point 62, the nozzles 46 on the oscillating tube 42 are angled longitudinally outwardly. The nozzle 46 located at the longitudinal center point 62 of the oscillating tube 42 projects perpendicularly to the longitudinal axis of the oscillating tube 42. The longitudinally outward angle of each nozzle increases from the longitudinal center point 62 toward the proximal end 54, and also from the longitudinal center point toward the distal end 58, as the nozzle's distance from the longitudinal center point 62 of the oscillating tube 42 increases.

Figure 2:
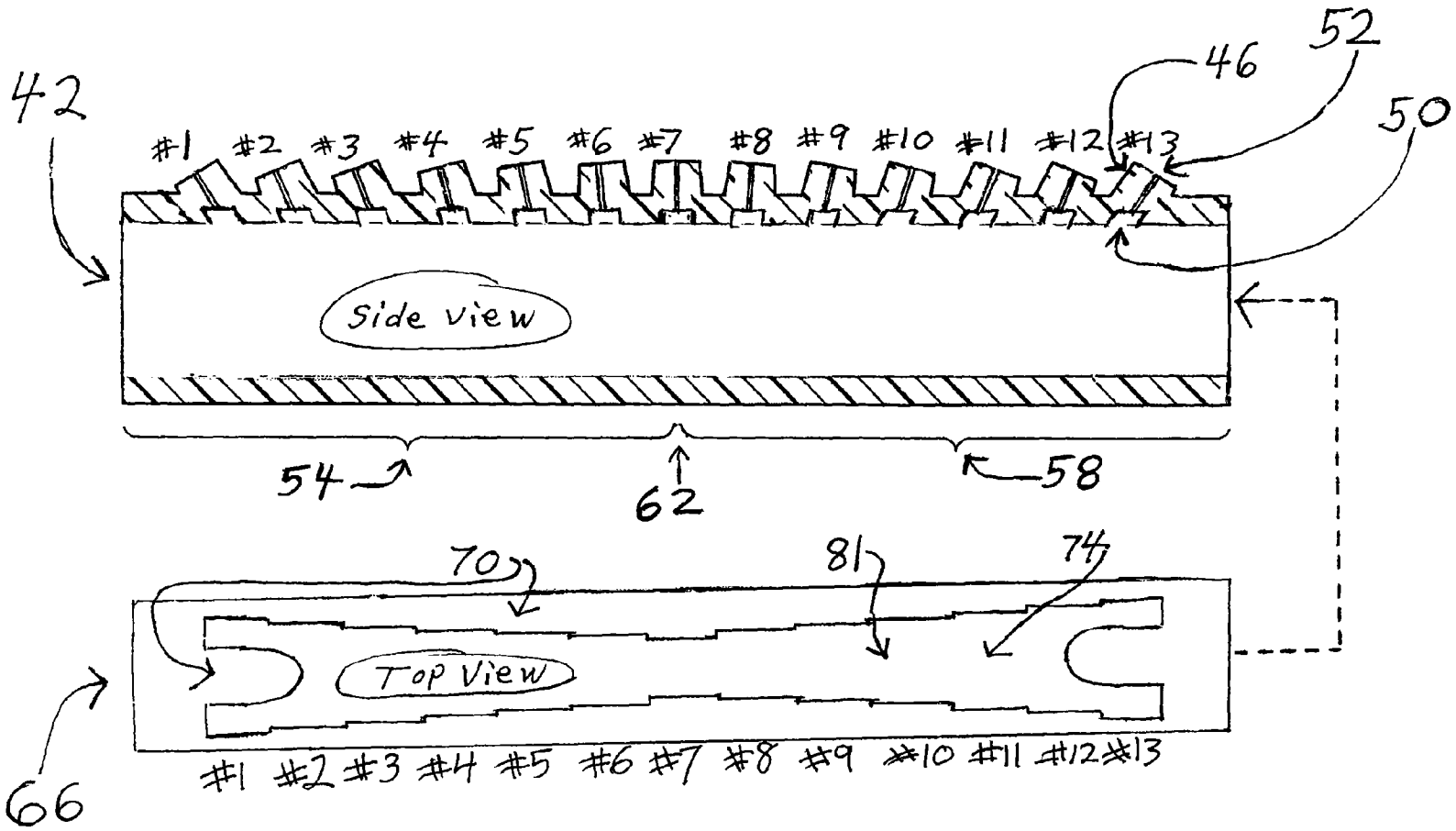
FIG. 2 is an exemplary drawing of an embodiment of the current invention depicting a top view of a stationary regulatory insert, and also a side view of an oscillating tube inside of which such a stationary regulatory insert may be disposed.
Figure 3:
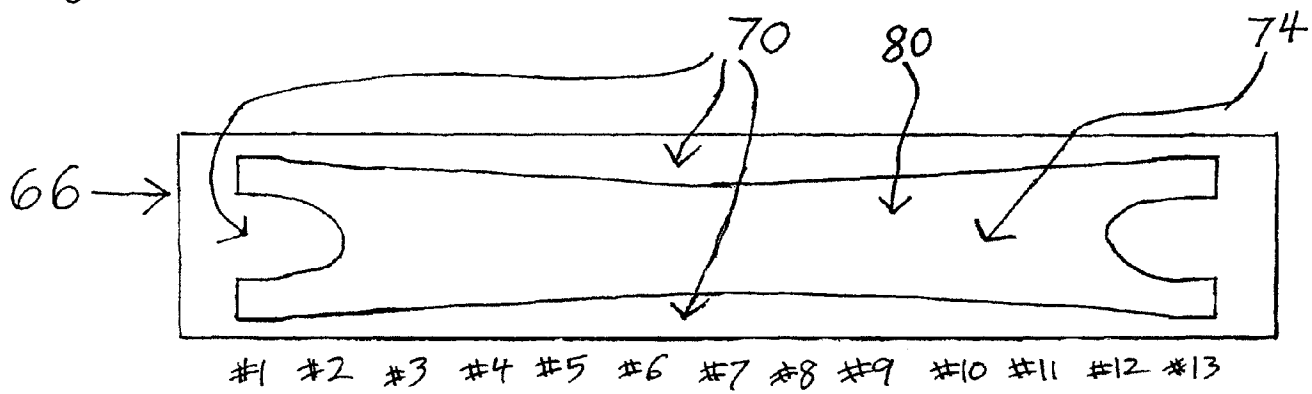
FIG. 3 is an exemplary top view of a stationary regulatory insert with a longitudinally-oriented contoured open area.
Figure 4:
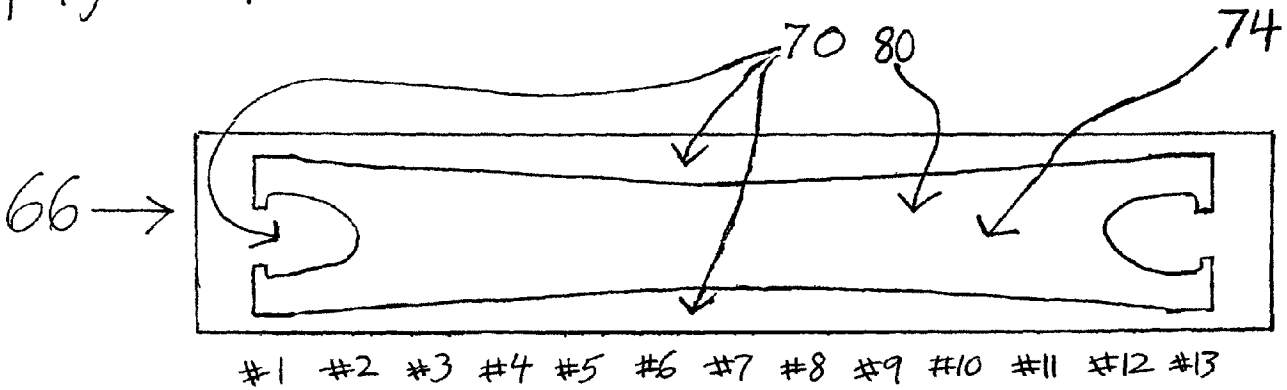
FIG. 4 is an exemplary top view of a stationary regulatory insert with a longitudinally-oriented contoured open area.
Figure 5:
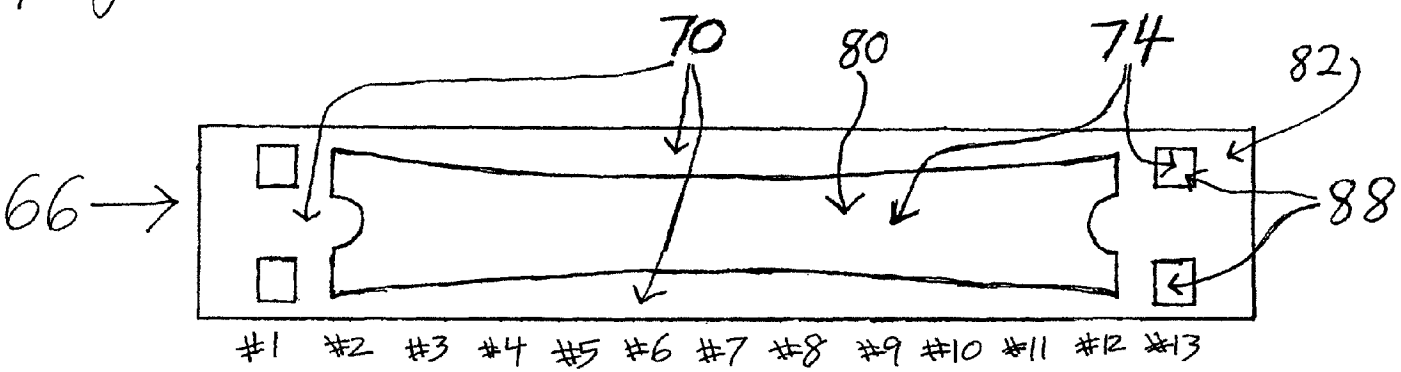
FIG. 5 is an exemplary top view of a stationary regulatory insert with a longitudinally-oriented contoured open area, flanges, and slots.
Figure 6:
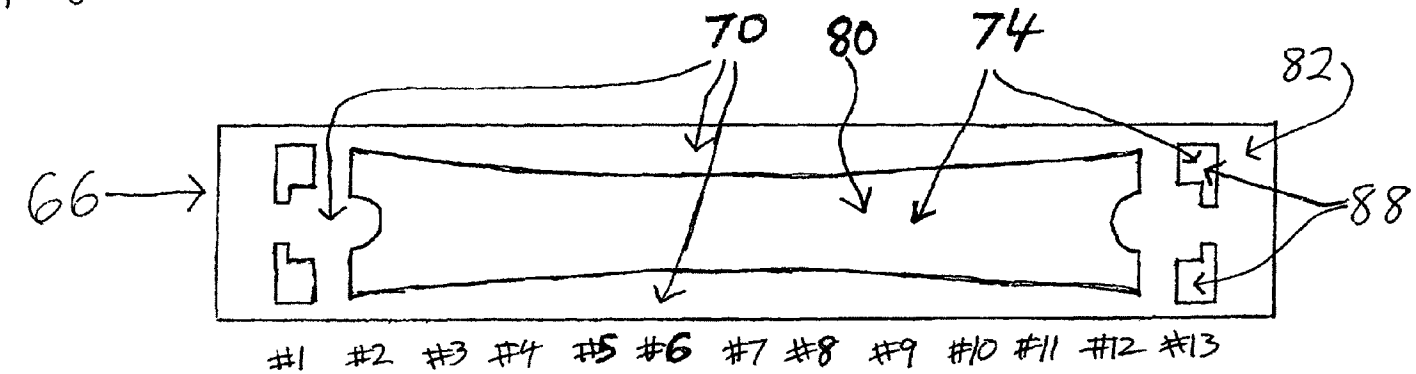
FIG. 6 is an exemplary top view of a stationary regulatory insert with a longitudinally-oriented contoured open area, flanges, and slots.
Figure 7:
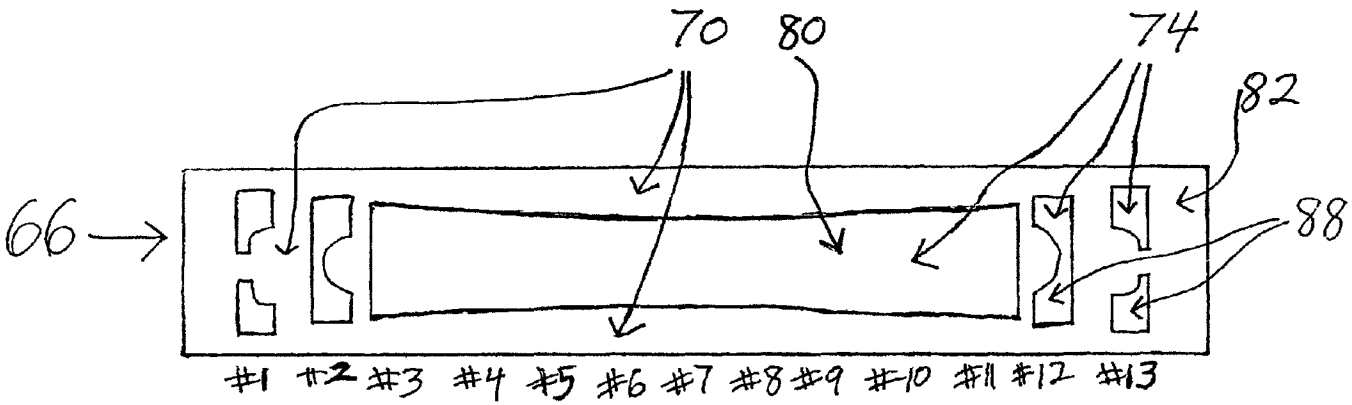
FIG. 7 is an exemplary top view of a stationary regulatory insert with a longitudinally-oriented contoured open area, flanges, and slots.

A concept of novelty of the current invention is the use of nozzle inlet openings that are of very large area measured in square millimeters for example, relative to the area of the nozzle outlet openings measured in square millimeters for example. The relatively large area of the nozzle inlet openings allows the components of the various stationary regulatory inserts to automatically and relatively accurately open and close and/or restrict flow to select nozzles at select points and within select portions of the oscillation cycle without the unreasonable or impossible geometric precision that would be necessary if the nozzle inlet openings were of relatively small area such as is typical of prior art oscillating sprinklers. Since round may be the most efficient shape with which to convey water, round nozzle inlet openings may be preferred but, in variations, other shapes such as circumferentially or longitudinally-oriented elongated shapes are contemplated. Also, as may be seen in FIGS. 8*a* and 8*b*, for example, the current invention may use an oscillating tube with relatively thick walls comprising nozzle inlet openings of relatively great "vertical length" or "depth". This may give voluminous, three-dimensional characteristics to the nozzle inlet openings, as seen in FIG. 2 for example.

In order to cause a current invention oscillating sprinkler to produce a substantially rectangular water distribution pattern instead of a generally elliptical water distribution pattern typical of prior art oscillating sprinklers, the horizontal distance from the sprinkler that streams of water travel before impacting the ground is automatically controlled. In a current invention sprinkler, the nozzles, by way of their nozzle inlet openings, receive full flow throughout the entire oscillation cycle with the exception that flow to select nozzles, by way of their nozzle inlet openings, at select points and/or within select portions of the oscillation cycle is automatically closed and/or restricted as is required to produce a substantially rectangular water distribution pattern.

In the current invention, flow restriction is accomplished by automatically controlling energy loss by configuring the geometry of the nozzle inlet openings on the inner wall of the oscillating tube to function together with the geometry of the components, i.e. the various size, shape, and location of open and closed areas of a stationary regulatory insert located inside of the oscillating tube.

The control of flow restriction facilitates control of energy loss which facilitates control of the horizontal distance from the sprinkler that streams of water travel before impacting the ground.

In the current invention oscillating sprinkler, the nozzle inlet openings typically are located on the inner wall of a straight oscillating tube, in a straight rectilinear row. Each nozzle inlet opening is located directly below its corresponding nozzle. Any time during the oscillation cycle that a nozzle inlet opening is positioned wholly above an open area of a stationary regulatory insert, the nozzle inlet opening receives full flow. Any time during the oscillation cycle that a nozzle inlet opening is positioned wholly above a closed area of a stationary regulatory insert, flow to the nozzle inlet opening is closed. Any time during the oscillation cycle that a nozzle inlet opening is simultaneously positioned partially above a closed area and partially above an open area of a stationary regulatory insert, the nozzle inlet opening receives restricted flow.

Geometric factors in a current invention oscillating sprinkler that automatically control the level of flow RESTRICTION, with a nozzle inlet opening simultaneously positioned partially above an open area, and partially above a closed area of a stationary regulatory insert thereby controlling the horizontal distance from the sprinkler that streams of water travel before impacting the ground, regarding select nozzles, at select points and/or within select portions of the oscillation cycle include, but may not be limited to the following:

1. THE DECREASE OF THE SIZE of the open portion of the entrance of the nozzle inlet opening.

2. The INEFFICIENCY OF THE SHAPE of the open portion of the entrance of the nozzle inlet opening. These shapes, which convey liquid less efficiently than round, may be variously shaped depending upon which of the available variations are used. They may be shaped, for example, somewhat like a partial circle, a crescent, or an elongated ellipse, etc.

3. The INEFFICIENCY OF THE TORTUOUS PATHWAY traveled by the water through the three-dimensional nozzle inlet opening. The pathway traveled by the water is tortuous, due partly to the fact that water enters the nozzle inlet opening at the bottom of the perimeter of the entrance of the nozzle inlet opening, but must move to the top center of the three-dimensional nozzle inlet opening in order to exit the nozzle inlet opening and enter the nozzle. Any TURBULENCE in the water caused by this tortuosity may further increase energy loss and flow restriction.

4. The INEFFICIENCY OF THE INCREASED LENGTH of the pathway traveled by the water from the bottom of the perimeter of the nozzle inlet opening to the top center of the three-dimensional nozzle inlet opening. This increased length of the pathway increases frictional energy loss and flow restriction where the water is in contact with the surfaces of the walls of the nozzle inlet opening and/or the side edge of the closed area of the stationary regulatory insert etc.

In the current invention, flow restriction typically may not be effected by merely closing off a percentage of the perimeter area of a nozzle inlet opening which may leave the center area generally or substantially open and may provide a direct and efficient path for the water. Rather, note that per the drawings and text of this disclosure, a percentage of the area extending to and/or sufficiently near the center of the nozzle inlet opening is closed, thereby effecting flow restriction by, for example, the aforementioned "size, shape, tortuosity, turbulence and length". Any part or component of a stationary regulatory insert intended to function as a closed area must be sized, shaped, and located etc., so as to extend sufficiently inwardly toward the center of the nozzle inlet opening. Thus, in the current invention the size, shape, location, and asymmetry, etc. of the closed areas of a stationary regulatory insert and the degrees of rotation of the oscillating tube, etc, are configured so that the closed area extends inwardly to and/or sufficiently near the center of the nozzle inlet opening so as to close off, not simply a percentage of the nozzle inlet opening, but specifically a percentage sufficiently at and/or near the center.

Note that with the above-described geometric configurations, flow restriction is effected by "size, shape, tortuosity, turbulence, and length" even though the geometric area, measured in square millimeters for example, of the portion of a nozzle inlet opening that remains open at the bottom of the perimeter of the nozzle inlet opening during an occurrence of flow restriction, has a geometric area, measured in square millimeters for example, greater than the geometric area of the nozzle outlet opening measured in square millimeters for example.

In order to produce substantially rectilinear widthwise and lengthwise boundaries, and thereby produce a substantially rectangular water distribution pattern, the degree at the right and left horizontal-most oscillating positions at which point the oscillating tube reverses it's direction of rotation must be coordinated with the numbers of, angles of, sizes of, and shapes of, and locations of the various components of the oscillating tube and the stationary regulatory insert to function together to automatically open and close and/or restrict flow to select nozzles at select points and/or within select portions of the oscillation cycle.

In general, a closed area of a stationary regulatory insert may close off a desired percentage of a nozzle inlet opening by being of the appropriate size, shape, and location. In general, as a nozzle inlet opening is being moved to a position above a closed area, at the point at which the center of the nozzle inlet opening becomes sufficiently near the edge of the closed area, the effects of "size, shape, tortuosity, turbulence, and length" discussed elsewhere in this disclosure begin to take effect. If the center of the nozzle inlet opening continues to move closer to the closed area, the effects of "size, shape, tortuosity, turbulence, and length" are increased and the amount of flow restriction effected is increased. Stated differently, in general, as the proximity of a given closed area to the center of a nozzle inlet opening increases, the amount of flow restriction effected increases. Stated differently, in general, as the proximity to the center of a nozzle inlet opening that a given closed area extends increases, the amount of flow restriction effected increases. Therefore, many variations of size, shape, and location of closed areas 70, degrees of oscillation of the oscillating tube 42, size, shape of nozzle inlet openings 50, etc. are contemplated, and must be configured and coordinated to produce the desired amount of flow restriction.

Figure 16:
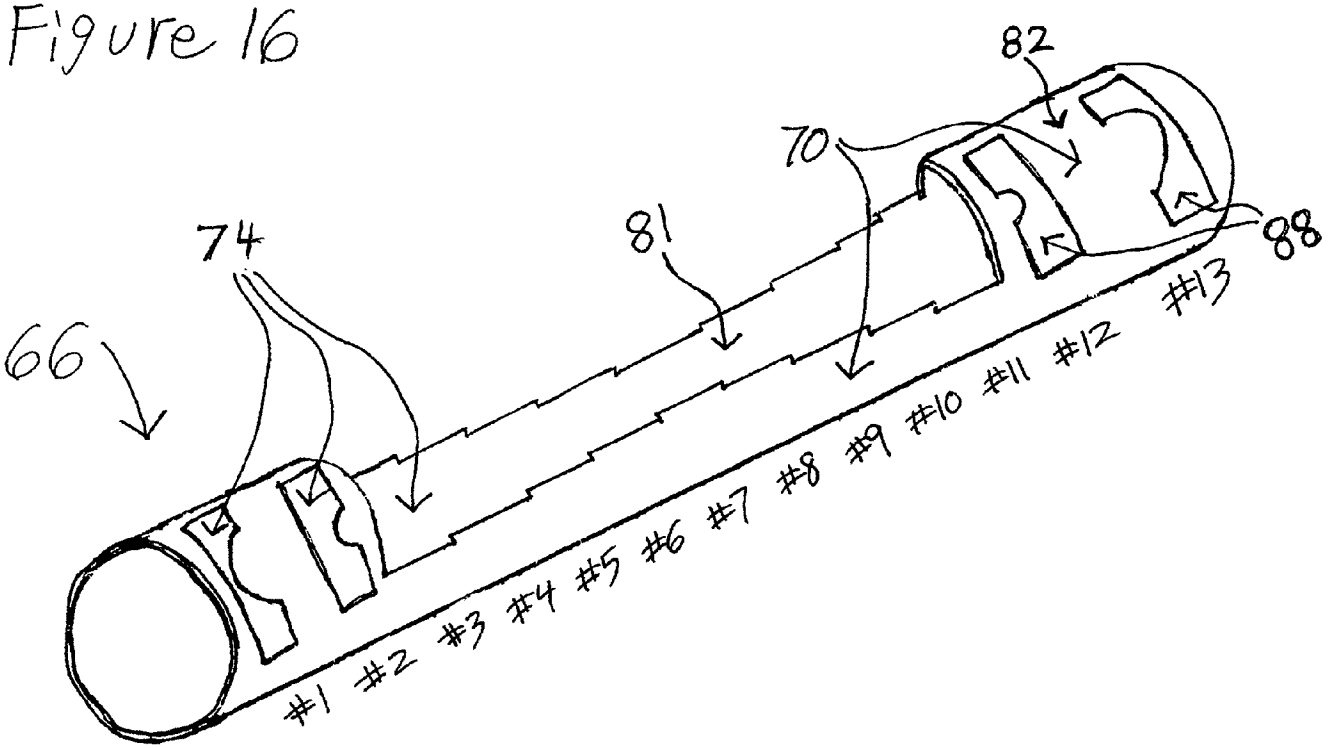
FIG. 16 is an exemplary perspective view of a stationary regulatory insert with a longitudinally-oriented stepped open area, flanges, and slots.
Figure 17:
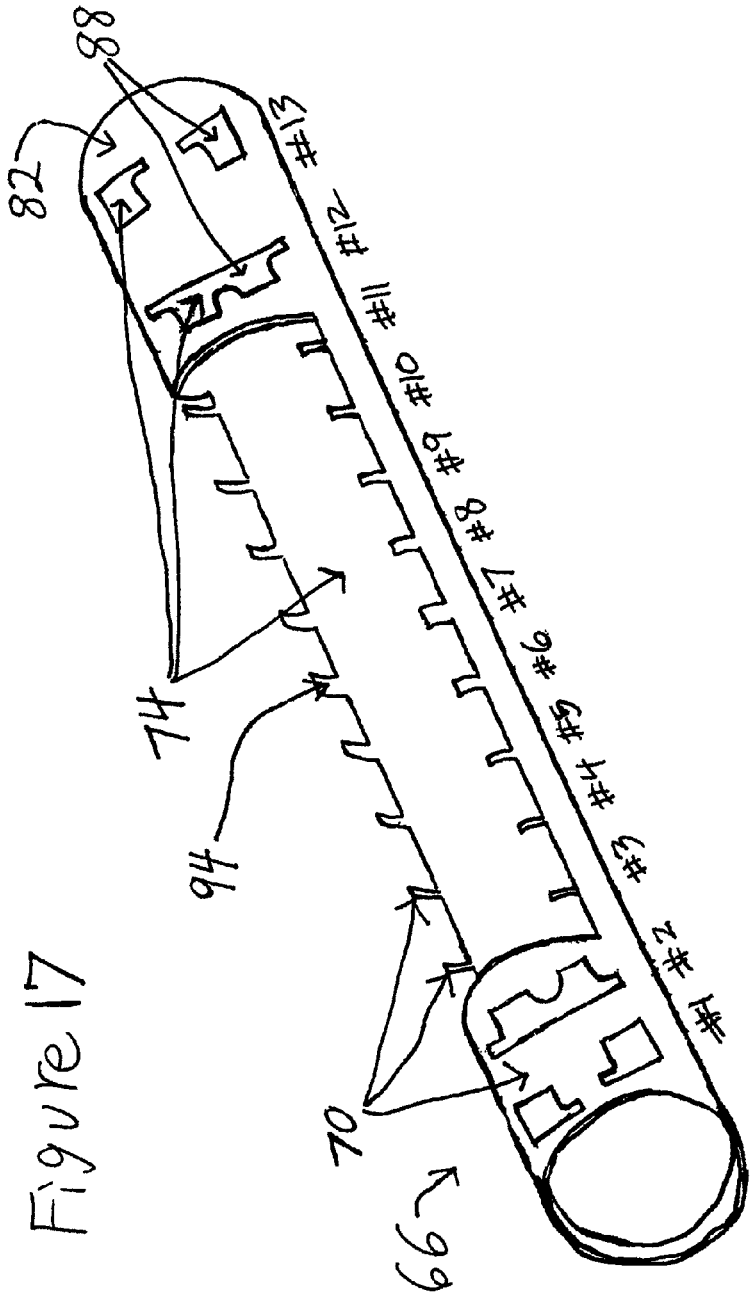
FIG. 17 is an exemplary perspective view of a stationary regulatory insert with tabs, flanges, and slots.
Figure 18:
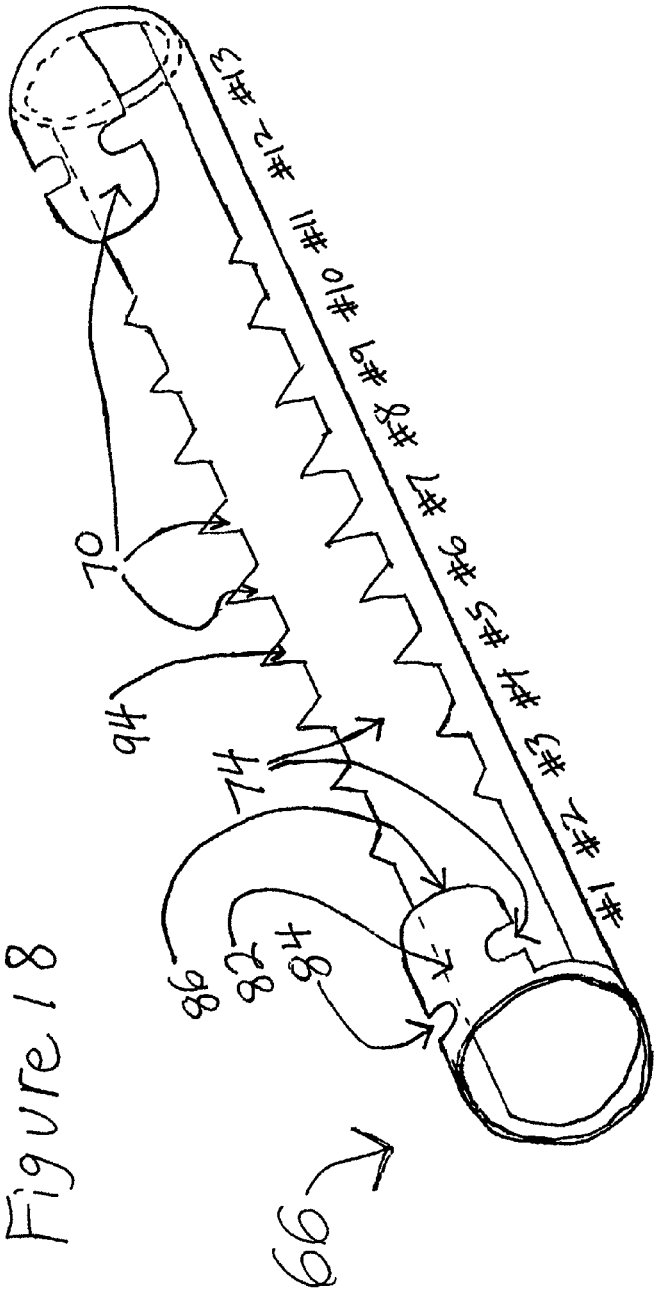
FIG. 18 is an exemplary perspective view of a stationary regulatory insert with tabs, and with flanges which comprise notches and contoured ends.
Figure 19:
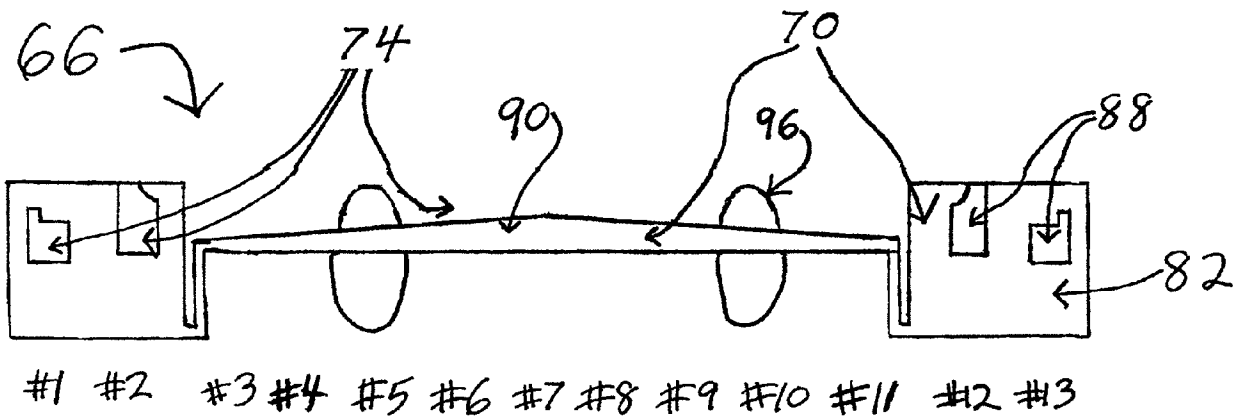
FIG. 19 is an exemplary side view of a stationary regulatory insert with tapered inter-flange extension, stabilizing rings, flanges, and slots.
Figure 20:
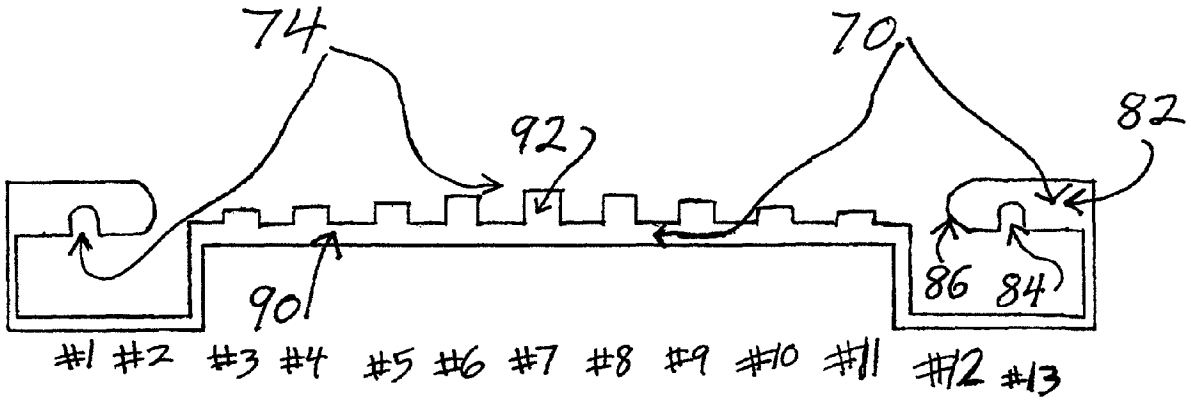
FIG. 20 is an exemplary side view of a stationary regulatory insert with inter-flange extension which comprises protrusions, and flanges which comprise notches and contoured ends.
Figure 21:
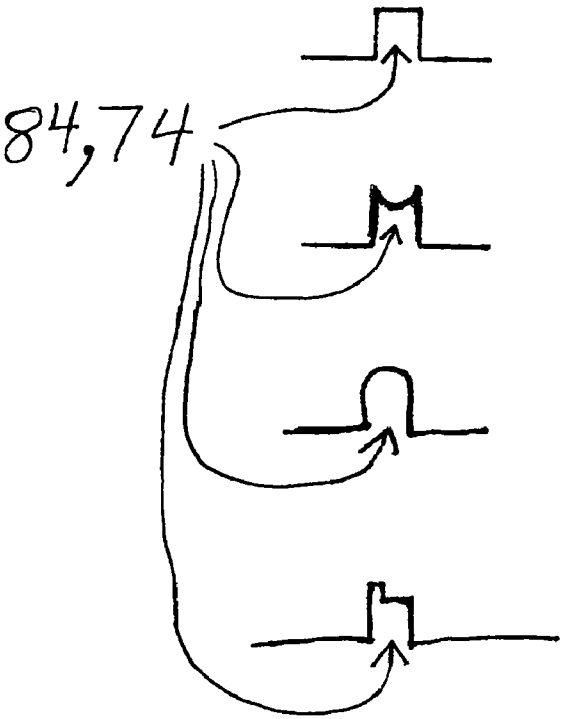
FIG. 21 is a representation of exemplary top views of notches which may be used as open areas on, for example, a flange of a stationary regulatory insert.

In the embodiments of FIGS. 3, 4, 5, 6, and 7, the circumferential length of the longitudinally-oriented contoured open area increases as the distance from the longitudinal center point increases. In the embodiment of FIG. 16, the circumferential length of the longitudinally-oriented stepped open area increases as the distance from the longitudinal center point increases. In the embodiment of FIG. 17, the longitudinal length of each tab decreases as the tab's distance from the longitudinal center point increases. In the embodiment of FIG. 18, the circumferential length of each tab decreases as the tab's distance from the longitudinal center point increases. In the embodiment of FIG. 19, the circumferential length of the tapered inter-flange extension decreases as the distance from the longitudinal center point increases. In the embodiment of FIG. 20, the circumferential length of each protrusion decreases as the protrusion's distance from the longitudinal center point increases.

The walls of the nozzle inlet opening may be designed to be generally perpendicular to the longitudinal axis of the oscillating tube, or may be generally parallel with the longitudinal axis of the nozzle outlet opening, for example.

The ceiling of the nozzle inlet opening may be designed to be generally parallel with the longitudinal axis of the oscillating tube, or may be generally perpendicular to the longitudinal axis of the nozzle outlet opening, for example.

With all other factors of the system being constant, variations in the size and shape of a relatively large "three dimensional" nozzle inlet opening may increase or decrease the amount of flow restriction. For example, if the surface where the walls meet the ceiling is relatively sharply angled or "squared," then tortuosity, turbulence, and length for example, may be enhanced and flow restriction may be greater than if the surface is curved. Also, for example, if the surface where the ceiling meets the nozzle outlet opening is relatively sharply angled or "squared," then tortuosity, turbulence, and length for example, may be enhanced and flow restriction may be greater than if the surface is curved and/or if the ceiling is somewhat domed or vaulted.

Figure 12:
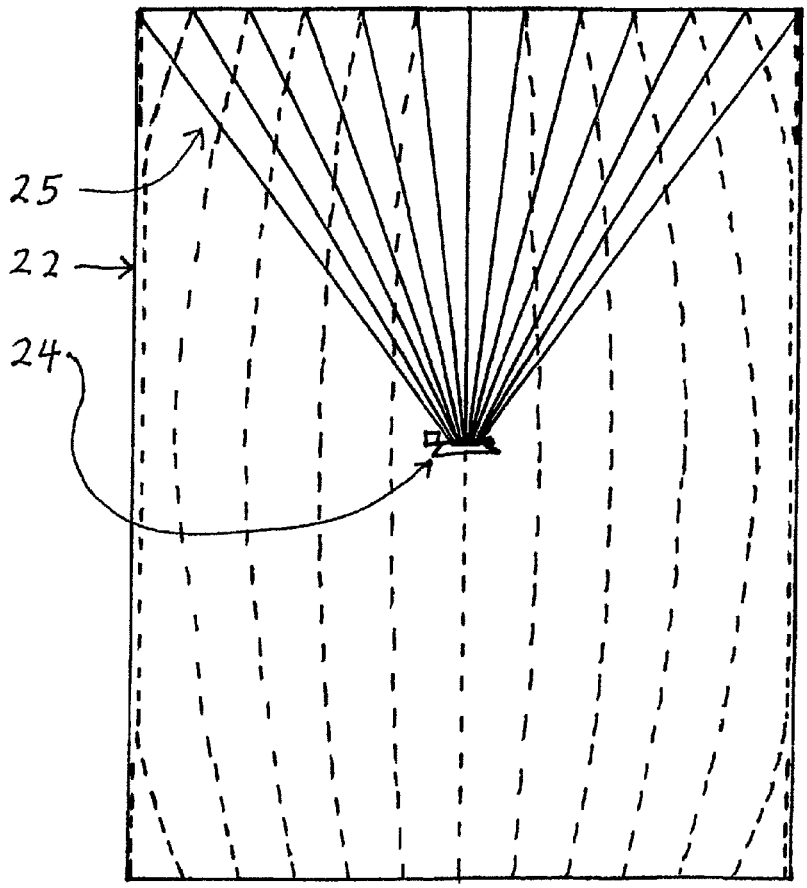
FIG. 12 is an exemplary top view of a typical substantially rectangular water distribution pattern that may be produced by a typical current invention oscillating sprinkler superimposed over a representation of a typical substantially rectangular area to be watered.

Beginning with the sprinkler 24 placed in the center of a typical rectangular area to be watered 22 and with the oscillating tube 42 in, in this example, the right horizontal-most oscillating position, the faucet is turned on. Water flows through the water supply hose, through the water motor, and through the oscillating tube water supply opening 38. Water flows through the open areas of the stationary regulatory insert 66, then flows through the nozzle inlet openings 50. The water then flows into the cylindrically-shaped nozzles 46 which force the water into the shape of narrow streams and force the streams to travel in the direction of the longitudinal axis of each nozzle 46. The water is then forced out of the nozzle outlet opening 52 of each of the nozzles 46. Thus, the water from each nozzle 46 travels in a narrow stream in a direction controlled by the angle of the nozzle, and travels a horizontal distance from the sprinkler before impacting the ground controlled by the stationary regulatory insert 66. In this right horizontal-most oscillating position water is flowing through all thirteen exemplary nozzles. The streams of water from the end-most nozzle at the proximal end 54 and the end-most nozzle at the distal end 58, i.e. exemplary nozzles #1 and #13, are of full flow from nozzle inlet openings 50 which, in this horizontal-most oscillating position are positioned wholly above open areas of the stationary regulatory insert 66, and are directed by the most longitudinally outwardly-angled nozzles, and thereby reach the corners of the substantially rectangular area to be watered and define and demarcate the corners of the substantially rectangular water distribution pattern. Also, in this right horizontal-most oscillating position, the streams of water from exemplary nozzles #2 through #12 are of flow restricted by the stationary regulatory insert whereby the flow to a given nozzle decreases as the nozzle's distance from the longitudinal center point 62 of the stationary regulatory insert 66 and oscillating tube 42 decreases. This is because the percentage of the nozzle inlet opening 50 that is closed by closed areas of the stationary regulatory insert decreases as the nozzle inlet opening's distance from the longitudinal center point increases. Thereby, the horizontal distance from the sprinkler that the stream of water from a given nozzle travels before impacting the ground decreases as the nozzle's distance from the longitudinal center point decreases. Thereby, one of the substantially rectilinear widthwise boundaries of the substantially rectangular water distribution pattern 25, geometrically compatible with the substantially rectilinear widthwise boundaries of a typical substantially rectangular area to be watered 22, is produced. This may be seen in FIG. 12 for example.

The current invention sprinkler functions according to the following description as the oscillating tube 42 begins its rotation from the above-described right horizontal-most oscillating position toward the vertical position. When the oscillating tube 42 has rotated a relatively short distance, the nozzle inlet opening 50 of the end-most nozzle at the proximal end 54, and the nozzle inlet opening of the end-most nozzle at the distal end 58, i.e. exemplary nozzles #1 and #13, are moved from a position wholly above an open area 74 of the stationary regulatory insert 66 to a position above a closed area 70. Movement to this position automatically closes water flow to those two nozzle inlet openings 50, thereby preventing exemplary nozzles #1 and #13 from producing streams of water with impact locations on the ground outside of the substantially rectilinear lengthwise boundaries of the substantially rectangular water distribution pattern 25 and outside of the substantially rectangular area to be watered 22. The transition from full flow to closed is not sudden nor abrupt because the size and shape of the nozzle inlet opening 50 is different than the size and shape of the open/closed area of the stationary regulatory insert 66 over which the nozzle inlet opening 50 is moved. For example, the nozzle inlet opening 50 may be round while the border of the open/closed area of the stationary regulatory insert 66 may be generally linear or of a curve different than that of the nozzle inlet opening. In any case, the closure occurs somewhat gradually and will effect an increase in pressure inside of the sprinkler but will not cause an undesired sudden nor abrupt pressure surge. Meanwhile, water continues to flow to all of the other nozzles, i.e. exemplary nozzles #2 through #12. Next, sequentially, as the oscillating tube 42 continues to rotate toward the vertical oscillating position, the nozzle inlet openings 50 of the nozzles 46 adjacent to the end-most nozzle at the proximal and distal ends, i.e. exemplary nozzles #2 and #12 are wholly above open areas of the stationary regulatory insert for an appropriate portion of the cycle towards the vertical position, then at the point in the rotation at which the impact location on the ground of the streams of water from exemplary nozzles #2 and #12 obliquely approach and begin to coincide with the substantially rectilinear lengthwise boundaries, the nozzle inlet openings 50 are automatically and continuously moved through positions simultaneously above partially open and partially closed areas of the stationary regulatory insert 66. Within this portion of the oscillation cycle, the percentage of the nozzle inlet opening 50 of exemplary nozzles #2 and #12 that is closed automatically increases progressively as the nozzle inlet openings 50 are moved continuously above, for example, a curved or contoured closed area 70 of the stationary regulatory insert 66 which borders an inversely-curved or contoured open area 74. The size and shape of the curve or contour of the closed area effects appropriately progressively restricted flow which progressively decreases the horizontal distance from the sprinkler 24 that the streams of water from exemplary nozzles #2 and #12 travel before impacting the ground as is required to produce the substantially rectilinear lengthwise boundaries of the substantially rectangular water distribution pattern 25. The percentage that is closed is greatest when the oscillating tube 42 reaches the vertical oscillating position. In this example, within this portion of the oscillation cycle, all of the other nozzles, i.e. exemplary nozzles #3 through #11 receive full flow because in this example, none of them would produce streams of water with impact locations on the ground outside of the substantially rectilinear water distribution pattern 25 nor outside of the substantially rectilinear lengthwise boundaries of a typical rectangular area to be watered 22. This may be seen in FIG. 12 for example.

As the oscillation cycle continues and the oscillating tube 42 rotates from the vertical position toward the left horizontal-most oscillating position flow to exemplary nozzles #1 and #13 continues to be closed, flow to exemplary nozzles #3 through #11 is full flow. The nozzle inlet openings 50 of exemplary nozzles #2 and #12 are automatically and continuously moved through positions simultaneously above partially open and partially closed areas of the stationary regulatory insert 66. Within this portion of the oscillation cycle the percentage of the nozzle inlet openings 50 that is open automatically increases progressively as the nozzle inlet openings are moved continuously above, for example a curved or contoured closed area of the stationary regulatory insert 66 which borders an inversely-curved or contoured open area. The size and shape of the curve or contour of the closed area effects appropriately progressively increased flow which progressively increases the horizontal distance from the sprinkler 24 that the streams of water from exemplary nozzles #2 and #12 travel before impacting the ground such as is required to produce the substantially rectilinear lengthwise boundaries of the substantially rectangular water distribution pattern 25 for an appropriate portion of the oscillation cycle from the vertical towards the left horizontal-most oscillating position. Then, at the point in the rotation at which impact locations on the ground no longer require flow restriction in order to be prevented from impacting the ground outside of the substantially rectilinear lengthwise boundaries, the nozzle inlet openings 50 are moved wholly over an open area 74 of the stationary regulatory insert 66 and receive full flow. Then, the impact locations on the ground obliquely approach the widthwise boundary as the oscillating tube 42 approaches the left horizontal-most oscillating position. Thereby, the substantially rectilinear lengthwise boundaries of the substantially rectangular water distribution pattern 25, geometrically compatible with the substantially rectilinear lengthwise boundaries of a typical substantially rectangular area to be watered 22, are produced. This may be seen in FIG. 12 for example.

When the oscillating tube 42, reaches the left horizontal-most oscillating position, the second substantially rectilinear widthwise boundary is produced by the same process as the above-described process which produced the first substantially rectilinear widthwise boundary. This may be seen in FIG. 12 for example.

In summary, regarding exemplary nozzles #1 and #13 which produce the corners of the substantially rectangular water distribution pattern, full flow is received when the oscillating tube is at and/or relatively near the right and left horizontal-most oscillating positions and flow is closed and/or restricted within the remainder of the oscillation cycle.

In summary, regarding exemplary nozzles #2 and #12 which are involved in producing both the lengthwise and also the widthwise boundaries: rotation of the oscillating tube from a horizontal-most oscillating position toward the vertical position produces automatic and progressive flow restriction as is required to produce the substantially rectilinear lengthwise boundaries. Conversely, rotation from the vertical position toward a horizontal-most oscillating position produces automatic and progressive flow increase as is required to produce the substantially rectilinear lengthwise boundaries. For a relatively small portion of the oscillation cycle near the right and left horizontal-most oscillating positions, wherein the impact locations on the ground will not occur outside of the lengthwise boundaries even with the nozzles receiving full flow, full flow is received. Then, when the oscillating tube is in a horizontal-most oscillating position, restricted flow is received. This may be seen in FIG. 12, for example.

In summary, regarding exemplary nozzles #3 through #11, full flow is received throughout the entire oscillation cycle except in the right and left horizontal-most oscillating positions wherein restricted flow is received.

In simplified general summary, regarding the dynamic portion of the oscillation cycle wherein the oscillating tube 42 is in motion, rotation from horizontal-most to vertical produces an automatic and sequential flow closing and/or restriction process. Rotation from vertical to horizontal-most produces an automatic and sequential flow opening and/or increasing process. Thereby, the substantially rectilinear lengthwise boundaries are produced. Regarding the relatively static portion of the oscillation cycle wherein the oscillating tube is horizontal-most, the flow to the nozzles 46 decreases as the nozzle's distance from the longitudinal center point 62 of the stationary regulatory insert 66 and the oscillating tube 42 decreases. Thereby, the substantially rectilinear widthwise boundaries are produced As may be seen in the appended drawings, generally, in regard to producing a substantially rectilinear widthwise boundary in a right or left horizontal-most oscillating position, regarding any of the exemplified stationary regulatory inserts, the size of an open area increases as the distance from the longitudinal center point increases. Stated differently, the size of a closed area decreases as the distance from the longitudinal center point increases.

In this example, the end-most nozzle at each end of the oscillating tube i.e. exemplary nozzles #1 and #13 function uniquely because these two nozzles, unlike all other nozzles, receive full flow in the right and left horizontal-most oscillating positions and thereby produce the four corners of the substantially rectangular water distribution pattern. As the oscillating tube rotates toward the vertical position, the flow to these two nozzles is either closed and/or restricted. These two nozzles are therefore involved in producing both the substantially rectilinear widthwise and lengthwise boundaries of the substantially rectangular water distribution pattern.

In this example, the nozzle medially adjacent to the end-most nozzle at each end of the oscillating tube i.e. exemplary nozzles #2 and #12 function uniquely because these two nozzles receive restricted flow in the right and left horizontal-most oscillating positions, then, also, as the oscillating tube rotates toward the vertical position and from vertical toward horizontal-most, the flow to these two nozzles typically is appropriately restricted as described above. These two nozzles are therefore typically involved in producing both the substantially rectilinear widthwise and lengthwise boundaries of the substantially rectangular water distribution pattern. This may be seen in FIG. 12 for example.

In this example, all of the other nozzles, i.e. exemplary nozzles #3 through #11 collectively function together uniquely as a unit because they typically receive full flow throughout the entire oscillation cycle except that they receive restricted flow at the right and left horizontal-most oscillating positions. These nozzles are involved with producing the substantially rectilinear widthwise boundaries, but typically, in this example, have no involvement in producing the substantially rectilinear lengthwise boundaries of the substantially rectangular water distribution pattern. (Of course, as mentioned elsewhere in this disclosure, in variations, depending on the total number of nozzles and the degrees of the angles of the longitudinally outwardly angled nozzles, etc., one, two, or more nozzles at each end of the oscillating tube may be involved in producing the substantially rectilinear lengthwise boundaries.)

In summary, in the current invention oscillating sprinkler, selective flow opening, closing, and/or restriction occurs automatically as the oscillating tube oscillates. As the oscillating tube oscillates, it moves the nozzle inlet openings, located on the inner wall of the oscillating tube, to positions wholly or partially above open and closed areas of the stationary regulatory insert located inside of the oscillating tube. Any time a nozzle inlet opening is positioned wholly over an open area of a stationary regulatory insert, the nozzle inlet opening receives full flow. Any time a nozzle inlet opening is wholly over a closed area of a stationary regulatory insert, flow to the nozzle inlet opening is closed. Any time a nozzle inlet opening is simultaneously positioned partially over a closed area and partially over an open area of a stationary regulatory insert, the nozzle inlet opening receives restricted flow. While temporarily in a position to receive restricted flow, the portion of the nozzle inlet opening that remains open has a decreased size, a shape other than round, and is located at the bottom of the perimeter of the entrance of the nozzle inlet opening. Flow restriction is thereby effected and the horizontal distance from the sprinkler that a given stream of water travels before impacting the ground is thereby controlled. The open and closed areas of the various stationary regulatory inserts available to the current invention are geometrically sized and shaped to function together with the geometry of the components of the oscillating tube, and the degrees of oscillation of the oscillating tube, etc., to automatically open and close, and automatically produce the required level of flow restriction to any given individual nozzle inlet opening at select points and within select portions of the oscillation cycle, as is required to produce a substantially rectangular water distribution pattern.

The volumetric flow provided to a given nozzle over the course of an entire oscillation cycle is generally or substantially proportional to the total area to which a given nozzle provides water.

Some embodiments of the current invention may comprise a stationary regulatory insert which comprises slots. Designs of slots may include but are not limited to those exemplified in the appended drawings and/or discussed in the text of this disclosure. Some variation of a stationary regulatory insert with a longitudinally-oriented contoured or stepped open area may be preferred at the time of this writing due in part to its simplicity. However, an embodiment comprising a stationary regulatory insert which may comprise, for example, a one-to-one ratio of slots to nozzles may also be considered.

(1) For example, a two-part slot with a closed center section may be used to provide full flow to a nozzle, exemplary nozzles #1 and #13 for example, to produce the corners of a substantially rectilinear water distribution pattern with the oscillating tube in a horizontal-most oscillating position. Then, as the oscillating tube rotates between its two horizontal-most oscillating positions, the closed center section may close flow to nozzles, exemplary nozzles #1 and #13, for example, within the portion of the oscillation cycle wherein the streams of water would otherwise produce impact locations on the ground outside of the substantially rectilinear lengthwise boundaries. Thereby, in general summary, a two-part slot with a closed center section may be used in producing the corners and the substantially rectilinear lengthwise boundaries.

(2) For example, a slot with an asymmetrically narrowed center section may be used to provide full flow to a nozzle, exemplary nozzles #1 and #13, for example to produce the corners of a substantially rectangular water distribution pattern in a horizontal-most oscillating position. Then, as the oscillating tube rotates between its two horizontal-most oscillating positions, the asymmetrically-narrowed center section may progressively restrict flow within the portion of the oscillation cycle wherein the streams of water would otherwise produce impact locations on the ground outside of the substantially rectilinear lengthwise boundaries. Within this portion of the oscillation cycle the amount of progressive flow restriction may produce impact locations substantially continuously along the substantially rectilinear lengthwise boundaries. Thereby, in general summary, a slot with an asymmetrically narrowed center section may be used in producing the corners, and the substantially rectilinear lengthwise boundaries. Furthermore, for example, a slot with an asymmetrically narrowed center section may also be used with, for example, exemplary nozzles #2 and #12 in which case it may also restrict flow in a horizontal-most oscillation position by being in variations, of shorter circumferential length than the end-most slots. In this case the nozzle inlet opening "stops" simultaneously partially above the open circumferentially-lateral end region of the slot and partially over the closed area circumferentially laterally "beyond" the slot in a horizontal-most oscillating position. This may be seen in FIG. 7 and FIG. 13, for example. Alternatively, a circumferentially-lateral end region of the slot may be sized and shaped to close off a desired percentage of a nozzle inlet opening "stopped" wholly above it in a horizontal-most oscillating position, this may be seen in FIG. 14, for example. Exemplary slots #2 and #12, for example, may thereby be involved in producing the substantially rectilinear widthwise boundaries. Then, as the oscillating tube rotates between its two horizontal-most oscillating positions, the asymmetrically-narrowed center sections may progressively restrict flow within the portion of the oscillation cycle wherein the streams of water would otherwise produce impact locations on the ground outside of the substantially rectilinear lengthwise boundaries. Within this portion of the oscillation cycle the amount of progressive flow restriction may produce impact locations on the ground substantially continuously along the substantially rectilinear lengthwise boundaries. Thereby, in general summary, a slot with an asymmetrically-narrowed center section may be used in producing the corners, and/or the substantially rectilinear widthwise, and/or substantially rectilinear lengthwise boundaries. The asymmetry of the narrowed center section of the slot causes water to enter the relatively large three-dimensional nozzle inlet opening, to progressive extents, at the perimeter of the bottom of the nozzle inlet opening, thereby effecting flow restriction progressively by "size, shape, tortuosity, turbulence, and length" as are discussed elsewhere in this disclosure.

(3) For example, slots with symmetrical center sections typically may be used to effect flow restriction in a horizontal-most oscillating position wherein the substantially rectilinear widthwise boundaries may be produced. This may be accomplished in at least two ways. (A) A nozzle inlet opening may be moved, in a horizontal-most oscillating position, to a position wholly above a circumferentially-lateral end region of the open area of a slot, in which case the size, shape, and location of the open area may close off a desired percentage of the nozzle inlet opening and may effect flow restriction by "size, shape, tortuosity, turbulence, and length" as are discussed elsewhere in this disclosure. (B) A nozzle inlet opening may be moved, in a horizontal-most oscillating position, to a position simultaneously partially above a circumferentially-lateral end region of the open area of a slot, and partially circumferentially-laterally "beyond" the open area of the slot, in which case a desired percentage of the nozzle inlet opening may be closed off and flow restriction may be effected by "size, shape, tortuosity, turbulence, and length" as are discussed elsewhere in this disclosure.

Figure 13:
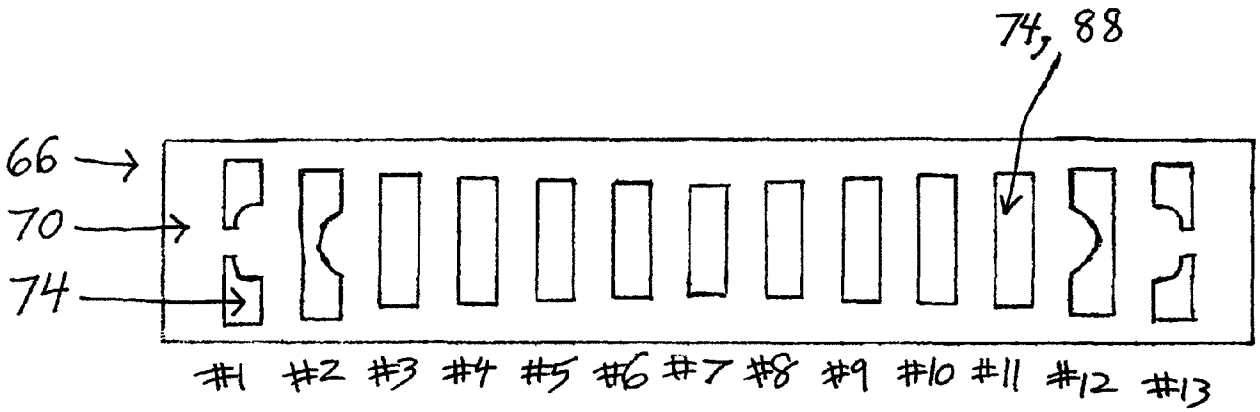
FIG. 13 is an exemplary top view of a stationary regulatory insert with slots.
Figure 14:
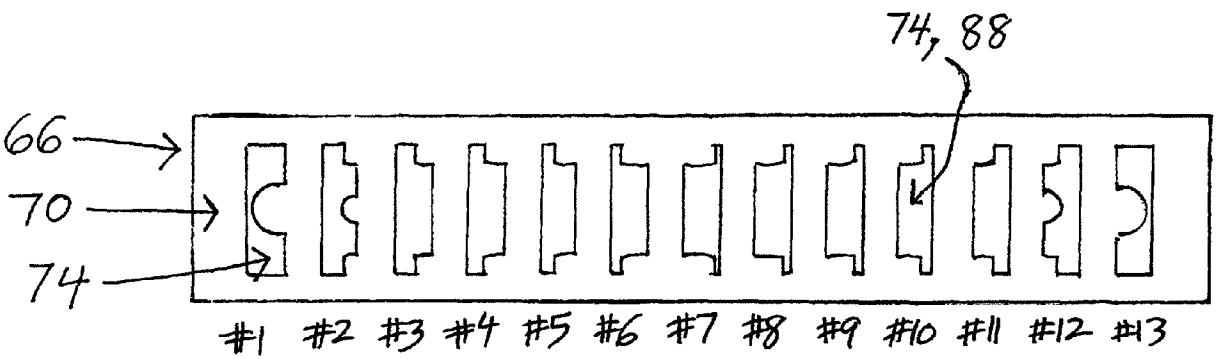
FIG. 14 is an exemplary top view of a stationary regulatory insert with slots.

In the embodiment of FIG. 13, the circumferential length of each slot increases as the slot's distance from the longitudinal center point increases. In the embodiment of FIG. 14, the longitudinal length of the open part at and/or near the circumferential end region of each slot increases as the slot's distance from the longitudinal center point increases.

Figure 11:
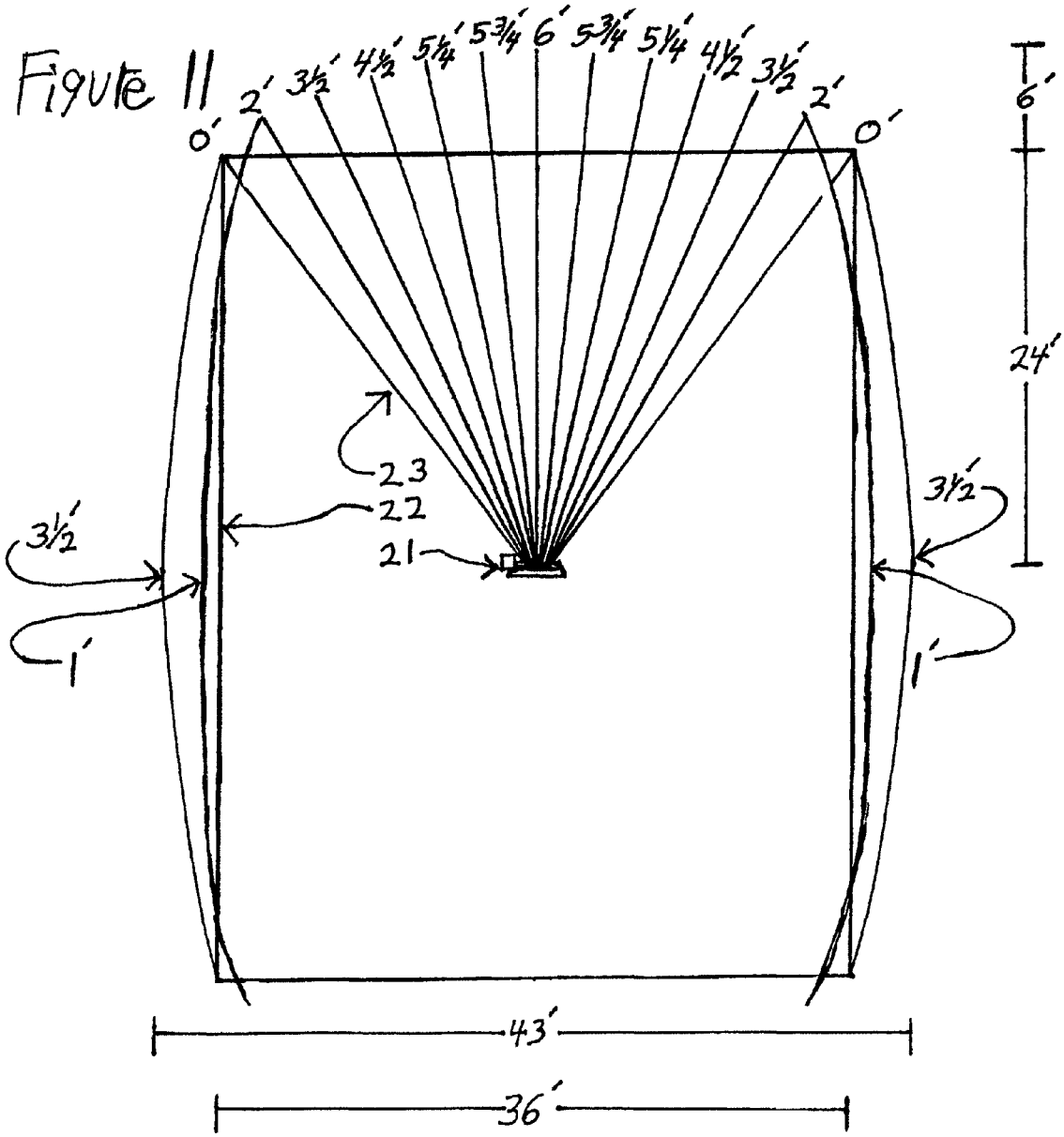
Prior Art Figure 11
FIG. 11 is an exemplary top view of a typical generally elliptical water distribution pattern of a typical prior art oscillating sprinkler superimposed over a representation of a typical substantially rectangular area to be watered. Also shown are approximate numbers of feet by which impact locations of the water on the ground fall outside of the linear lengthwise and widthwise boundaries.

In general, a typical prior art oscillating sprinkler may, at and/or near its vertical oscillating position provide less water per square foot of ground than per square foot of ground in other areas of the generally elliptical water distribution pattern. At and/or near the vertical oscillating position, the widthwise dimension of the generally elliptical water distribution pattern may be maximally wide, the streams of water from longitudinally-outwardly angled nozzles therein producing impact locations on the ground more widely dispersed than at other points within the oscillation cycle. This may be seen in FIG. 11 for example. Stated differently and simply, regarding a prior art oscillating sprinkler, generally, the amount of water received per square foot of ground may decrease as the width of the generally elliptical water distribution pattern increases.

Conversely, a current invention oscillating sprinkler 24, typically with one or more nozzles 46 at and/or near each end of the oscillating tube 42 with closed flow and/or restricted flow at and/or near the vertical oscillating position, may provide generally or substantially the same amount of water per square foot of ground as to square foot of ground in other areas of the substantially rectangular water distribution pattern 25. This may be because the resulting water distribution pattern is not wider at and/or near the vertical oscillating position and also may be because closing and/or restricting flow to, for example exemplary nozzles #1, #13 and #2, #12 may increase the pressure inside of the sprinkler and cause the nozzles that are receiving full flow, exemplary nozzles #3 through #11, for example, to emit more water per second during the time period wherein the oscillating tube 42 is at and/or near the vertical oscillating position. Within this portion of the oscillating cycle the impact locations on the ground of streams of water from exemplary nozzles #3 through #11 for example, may be dispersed more widely than within portions of the oscillation cycle at and/or more near the horizontal-most portions, but these nozzles may emit more water per second, and may, by emitting more water per second, at least partially counteract the effect of the wider dispersion. Thereby a current invention oscillating sprinkler which may produce a substantially rectangular water distribution pattern may provide water more evenly than a typical prior art oscillating sprinkler which typically produces a generally elliptical water distribution pattern.

Also, in general, at its horizontal-most oscillating position the oscillating tube of a typical prior art oscillating sprinkler typically slows down and stops during its process of changing direction of rotation. The oscillating tube may be in a horizontal-most position for a relatively long period of time compared to the period of time that it is in any other point or position of its oscillation cycle. During the relatively long period of time that a prior art sprinkler is in a horizontal-most position, all of its nozzles are typically receiving full flow, thereby typically delivering more water per square foot to each "end" area of its generally elliptical water distribution pattern than to any other area. In a horizontal-most position, the NARROWNESS of the water distribution pattern, the FULL FLOW, and the relatively LONG PERIOD OF TIME may cause over-watering often referred to as "puddling".

Conversely, whereas a current invention oscillating sprinkler may also spend a relatively long period of time in its horizontal-most positions, the problem of "puddling" may be abated by the flow restriction to all of the nozzles except the end-most nozzle at each end, as discussed elsewhere in this disclosure. Stated differently, the same flow restriction of a current invention oscillating sprinkler that produces a substantially rectilinear widthwise boundary may abate the problem of over-watering or "puddling" during the time that the oscillating tube is in a horizontal-most oscillating position.

Furthermore, in variations, any of the various stationary regulatory inserts available to the current invention may be configured so that a closed area effecting flow restriction in a horizontal-most oscillating position to for example, the even numbered nozzles, may be sized and/or shaped to effect an "additional" amount of flow restriction and a corresponding additional decrease in the horizontal distance from the sprinkler that the stream of water travels before impacting the ground. This variation may be most easily contemplated by observing FIG. 2 or FIG. 13 for example, however, the difference in the size and/or shape of the closed areas corresponding to even-numbered nozzles for this variation may be too minute to accurately depict or notice in a drawing. This may produce, in a horizontal-most oscillating position, a pattern of staggered or zig-zag impact locations along the substantially rectilinear widthwise boundaries, thereby abating a problem of "puddling". The impact locations on the ground of streams of water emanating from even-numbered nozzles, for example, may be configured in a curve, for example, having impact locations more near the widthwise boundary at and/or near the side-to side center region of the widthwise boundary than at the left or right end regions of the widthwise boundary. This configuration puts even-numbered nozzles' impact locations nearer the widthwise boundary at and/or near the center of the widthwise boundary wherein flow restriction to the odd-numbered nozzles is greatest, and puts even-numbered nozzles' impact locations more medial toward the lengthwise center of the lengthwise dimension of the substantially rectangular water distribution pattern at and/or near the left and right ends of the widthwise boundary wherein flow restriction to odd-numbered nozzles is lesser. This may be seen in FIG. 32 for example. This variation may represent the most evenness of water distribution reasonably achievable with the current invention.

Figure 31:
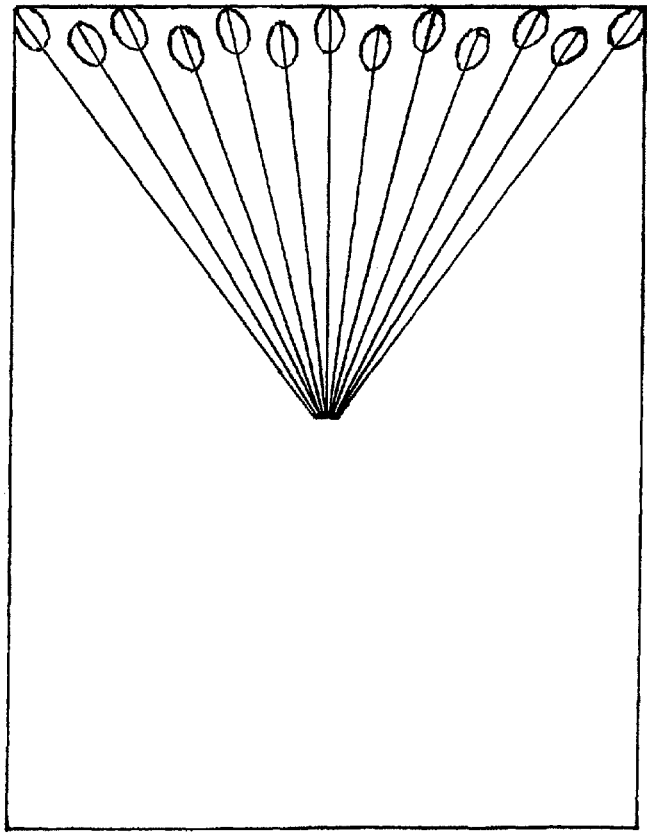
FIG. 31 is an exemplary top view of staggered or zig-zag impact locations of water from a variation of the current invention in a horizontal-most oscillating position.
Figure 32:
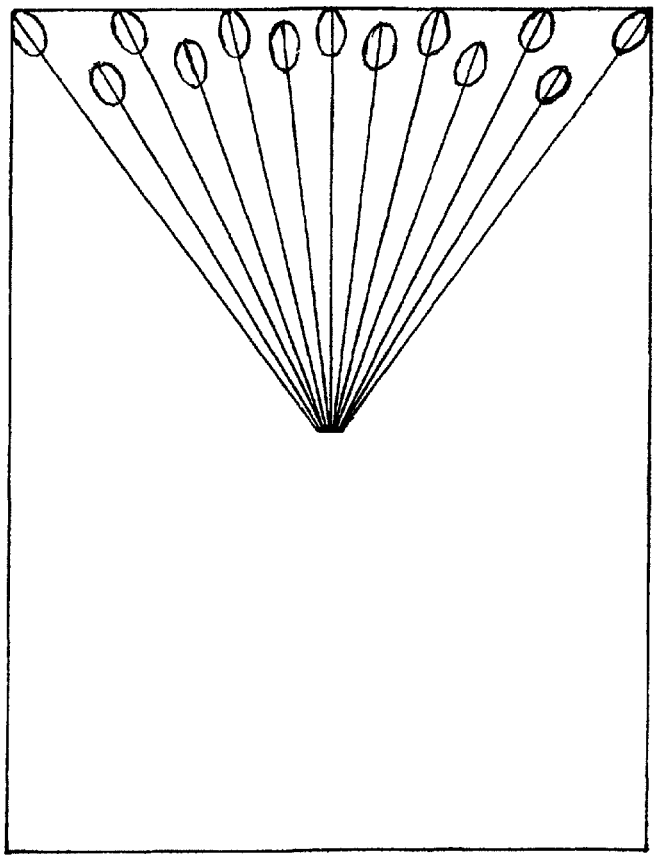
FIG. 32 is an exemplary top view of staggered or zig-zag impact locations of water with curved pattern of impact locations from exemplary even-numbered nozzles of a variation of the current invention in a horizontal-most oscillating position.

In summary, whereas the relatively long period of time that a current invention sprinkler spends in a horizontal-most position may be similar to that of a typical prior art sprinkler, the water distribution pattern is not narrower, the flow is restricted, and the impact locations may be staggered or zig-zag, in a linear configuration as shown in FIG. 31 for example, or in a curved configuration as shown in FIG. 32 for example. The staggering or zig-zag pattern of impact locations and the flow restriction may counteract the potential over-watering or "puddling" effect that may be caused by the relatively long period of time that the oscillating tube is in a horizontal-most position. The problem of "puddling" that may be typical of typical prior art sprinklers may thereby be abated by a current invention sprinkler.

Thereby, a current invention oscillating sprinkler may distribute water more evenly throughout its distribution pattern, both widthwise and lengthwise, than does a typical prior art oscillating sprinkler.

If a variation producing a linearly-oriented, or a curved staggered or zig-zag impact location pattern is used, enhanced evenness of water distribution may be achieved if more than the exemplary number of 13 nozzles are used, 15 or 17 nozzles, for example.

The design of the oscillating tube and the various stationary regulatory inserts of the current invention oscillating sprinkler may be symmetrical. Therefore, the oscillation mechanism of the current invention oscillating sprinkler may be adjusted so that the oscillating tube rotates back and forth from the vertical oscillating position to either only the right, or only the left horizontal-most oscillating position thereby producing a substantially rectangular water distribution pattern generally located in one direction from the current invention sprinkler. In this case, the sprinkler typically may not be placed in the center of the area to be watered, but typically may be placed at one edge of the area to be watered.

It should be realized that there is a margin of error applicable to any typical watering situation for reasons such as, but not limited to the following:

A typical substantially rectangular area to be watered may not be geometrically perfect. It may not have perfectly rectilinear boundaries nor perfect 90 degree angles in the corners.

A stream of water may be relatively small diametrically, for example, less than 1/16th of an inch, when it exits a nozzle, but the area of the ground actually impacted by the stream of water may be relatively large, 1 ft. by 2 ft. for example, and may be larger if the wind is blowing.

Upon impacting the ground, water tends to spread out in all directions horizontally as it soaks into the ground vertically, except when it comes in contact with something substantially impermeable such as a street, driveway, or the foundation of a house.

These factors, and others, provide a "margin of error" in producing a substantially rectangular water distribution pattern. Therefore, to the extent that the substantially rectangular water distribution pattern of a current invention oscillating sprinkler is not geometrically perfect, it may be none the less, substantially geometrically compatible with a typical area to be watered. A current invention oscillating sprinkler may reduce waste water, may reduce run-off waste water, may prevent water damage to things not intended to be in contact with the water, and may efficiently and automatically provide water to the corner areas of typical substantially rectangular areas to be watered.

A typical prior art oscillating tube has, for example, a ½ inch inside diameter. However, some have a much larger diameter. The "Melnor" model 4100, for example, has an oscillating tube with an inside diameter of almost 2 inches. It may be advantageous, in regard to the current invention, to use an oscillating tube with a relatively large inside diameter so that the geometric area of the nozzle inlet opening, measured in square millimeters for example, and the stationary regulatory insert and its components placed inside of the oscillating tube, may be proportionally large. This may afford ease of manufacturing and may require less precision of size and shape of the components. Relatively large components, an open area of a stationary regulatory insert with a longitudinally-oriented contoured or stepped open area 80 or 81, for example, may function better and for a longer period of time having sufficiently large open areas to allow, for example, for the passage of a grain of sand, and may be minimally affected by a small build-up of mineral deposits, for example.

Some variations of stationary regulatory inserts of the current invention use two-part slots with closed center sections below one or more nozzle inlet openings at and/or near each end of the oscillating tube. The open portions of the two-part slots provide full flow to the associated nozzle inlet openings at and/or near the right and left horizontal-most oscillating positions wherein the associated nozzles produce the corners of the substantially rectangular water distribution pattern. The closed center sections close the flow to select nozzle inlet openings at and/or near each end of the oscillating tube within select portions of the oscillation cycle, thereby facilitating the production of the substantially rectilinear lengthwise boundaries of the substantially rectangular water distribution pattern. If two-part slots with closed center sections are used, the circumferential length of the closed center sections must be sufficient relative to the circumferential length of the nozzle inlet opening so that the nozzle inlet opening is positioned wholly over the closed center section within the select portion of the oscillation cycle as is required to produce the substantially rectilinear lengthwise boundaries. Therefore, the inside diameter of the oscillating tube must be sufficiently large, and the circumferential length of the closed center sections on the stationary regulatory insert proportionally great, and/or, the circumferential length of the nozzle inlet openings must be sufficiently small. Therefore, an oscillating tube with a relatively large diameter may represent an advantageous variation, however, also, longitudinally elongated nozzle inlet openings of relatively small circumferential length may represent an advantageous variation. It may be advantageous that the diameter of the oscillating tube be sufficiently large to accommodate a stationary regulatory insert with closed center sections of sufficiently great circumferential length in order that the nozzle inlet openings that are used may be of a shape that may be preferred, the preferred shape may be round.

At the time of this writing, a preferred embodiment may comprise a stationary regulatory insert 66 with a longitudinally-oriented contoured or stepped open area. Of all of the stationary regulatory inserts contemplated, a stationary regulatory insert with a longitudinally-oriented contoured or stepped open area may be the simplest in design and may be the least expensive to manufacture.

The applicant of this invention considers his invention to extend broadly to any suitable manner of configuring the nozzles of a sprinkler to vary the horizontal distance from the sprinkler that a stream emanating therefrom will travel, and to any suitable manner of automatically and sequentially opening, closing, increasing, and/or decreasing water flow to nozzles.

Figure 15:
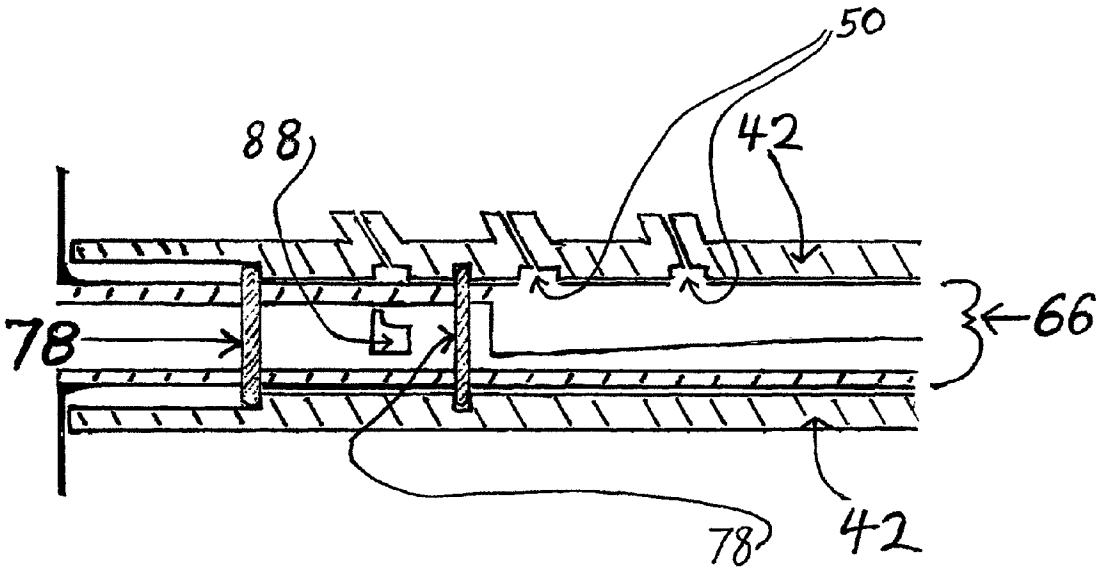
FIG. 15 is an exemplary side view of an embodiment of the current invention showing typical location of an "o" ring at or near the proximal end of the oscillating tube and a contemplated location of a second "o" ring longitudinally medially therefrom, in a variation.

The written descriptions and appended drawings of this disclosure are merely exemplary and are not meant to limit the scope of the invention. Many variations to the invention have been contemplated as would be apparent to one of ordinary skill in the art with the benefit of this disclosure. Possible variations include, but are not limited to, the following examples:

In variations, the "vertical length" or "depth" of each relatively large "three-dimensional" nozzle inlet opening may be oriented at the same angle as the longitudinal axis of its corresponding nozzle as shown in FIG. 2, for example. In other variations, the "vertical length" of "depth" of each nozzle inlet opening may be oriented perpendicularly to the longitudinal axis of the oscillating tube as shown in FIG. 15, for example.

In variations, more than, or fewer than 13 nozzles may be used. Also, the degrees of the longitudinally-outward angles of the nozzles may vary. Accordingly, for example, one, two, or more nozzles at each end of the oscillating tube may be configured to be involved in producing the substantially rectilinear lengthwise boundaries of the substantially rectangular water distribution pattern by receiving full flow, closed flow, and/or appropriately restricted flow within appropriate points and/or portions of the oscillation cycle.

In variations, appropriately configuring available variables such as the total number of, and longitudinally-outward angle of, nozzles; the number of nozzles at each end of the oscillating tube that are involved in producing the substantially rectilinear lengthwise boundaries and corners; and appropriately closing flow, providing full flow, and/or appropriately restricting flow at appropriate points and within appropriate portions of the oscillation cycle may provide generally or substantially the same amount of water per square foot along the lengthwise boundaries as is provided to a given square foot elsewhere within the substantially rectangular water distribution pattern thereby avoiding under-watering and/or over-watering of the ground at and/or near the lengthwise boundaries. This may be exemplified in FIG. 12, for example.

In variations, some variation of a stationary regulatory insert with a longitudinally-oriented contoured or stepped open area 80 or 81 may, at the time of this writing, be preferred due in part to its simplicity. However, many designs of stationary regulatory inserts may be contemplated, including but not limited to those specifically exemplified in the appended drawings and/or specifically described in the text of this disclosure. In general, stationary regulatory inserts may be tubular or arcuate, or a combination thereof. An arcuate stationary regulatory insert or part thereof may extend circumferentially throughout a functionally sufficient number of degrees of the arc of a portion of the interior wall of the oscillating tube, 180 degrees, for example. Also, in general, a stationary regulatory inset may comprise a wide variety of components that function as open or closed areas including, but not limited to for example, longitudinally-oriented contoured open area 80, longitudinally-oriented stepped open area 81, flange 82, notch 84, contoured end of flange 86, slot 88, inter-flange extension 90, protrusion 92, tab 94, etc. as may be seen in the appended drawings.

In variations, the oscillation may be powered by a water motor or by any other means such as an electric motor. The sprinkler is not limited to spraying water only, but may spray any suitable liquid such as fertilizer solutions. Tubes and other sprinkler components may be made of various materials including but not limited to plastic, rubber, polymeric, metallic or composite materials, etc.

Figure 23:
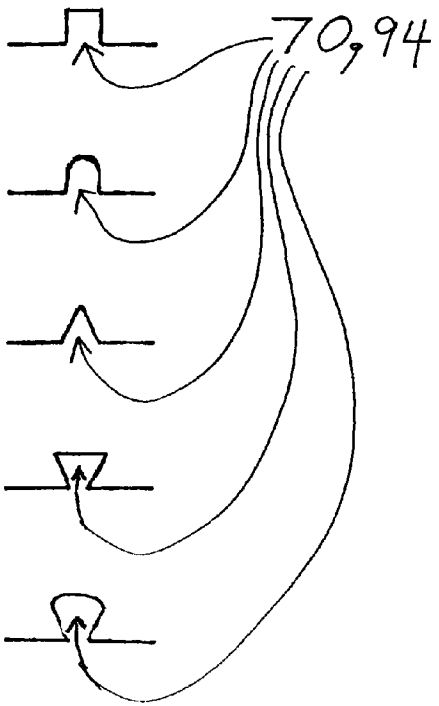
FIG. 23 is a representation of exemplary side views of tabs which may be used as closed areas of a stationary regulatory insert.
Figure 24:
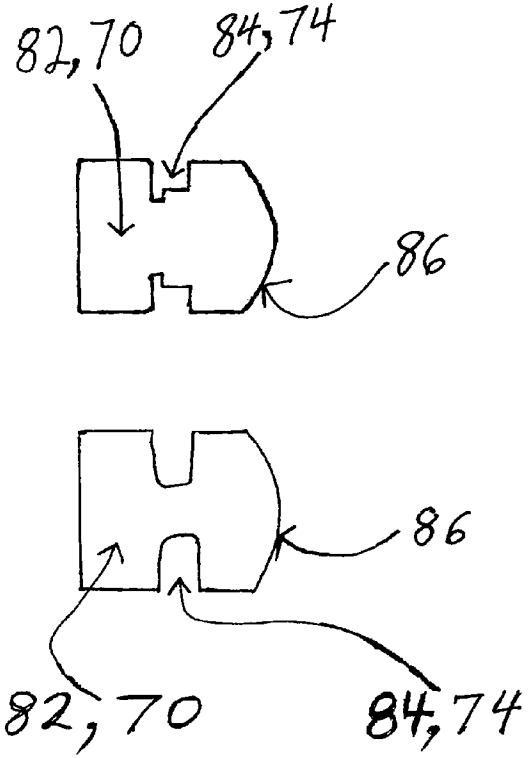
FIG. 24 is a representation of exemplary top views of flanges which comprise notches and contoured ends and may be a part of a stationary regulatory insert.
Figure 25:
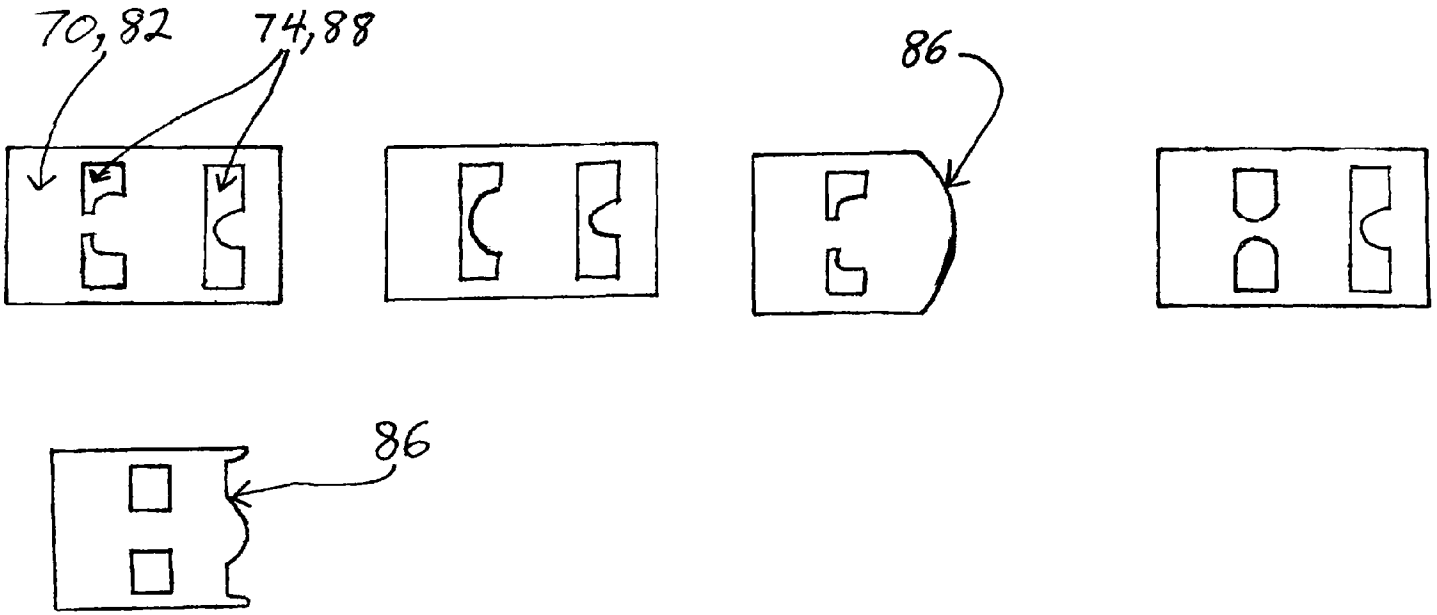
FIG. 25 is a representation of exemplary top views of flanges which comprise slots and may also comprise contoured ends, and may be a part of a stationary regulatory insert.
Figure 26:
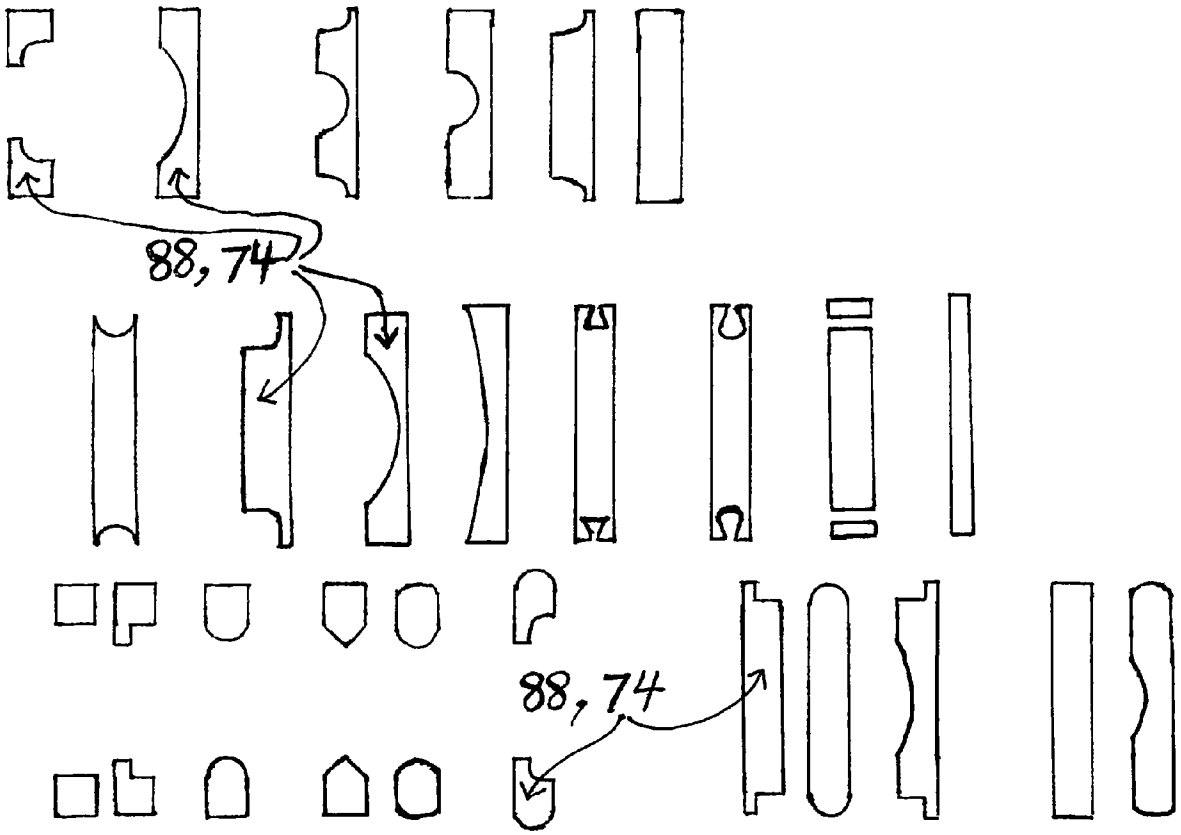
FIG. 26 is a representation of exemplary top views of slots which may be used as open areas of a stationary regulatory insert.
Figure 27:
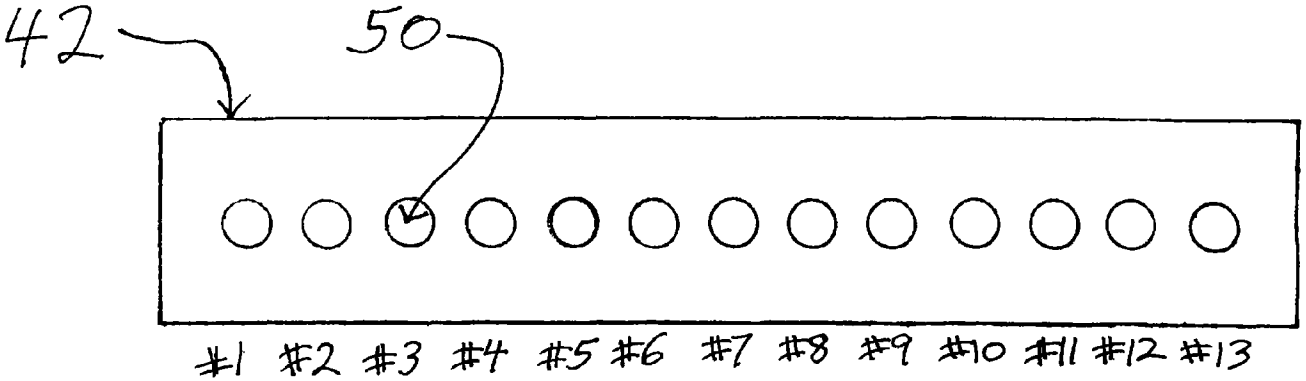
FIG. 27 is an exemplary top view of oscillating tube and round nozzle inlet openings.
Figure 28:
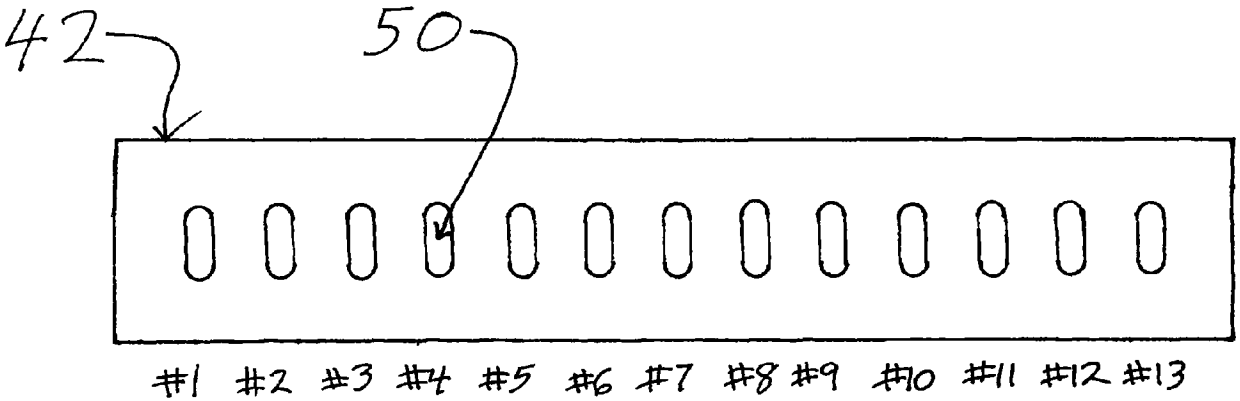
FIG. 28 is an exemplary top view of oscillating tube and circumferentially-elongated nozzle inlet openings.
Figure 29:
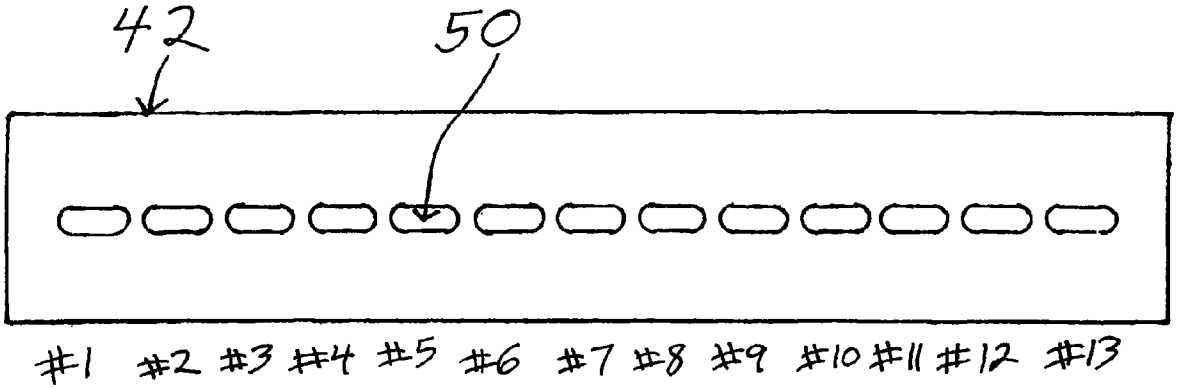
FIG. 29 is an exemplary top view of oscillating tube and longitudinally-elongated nozzle inlet openings.
Figure 30:
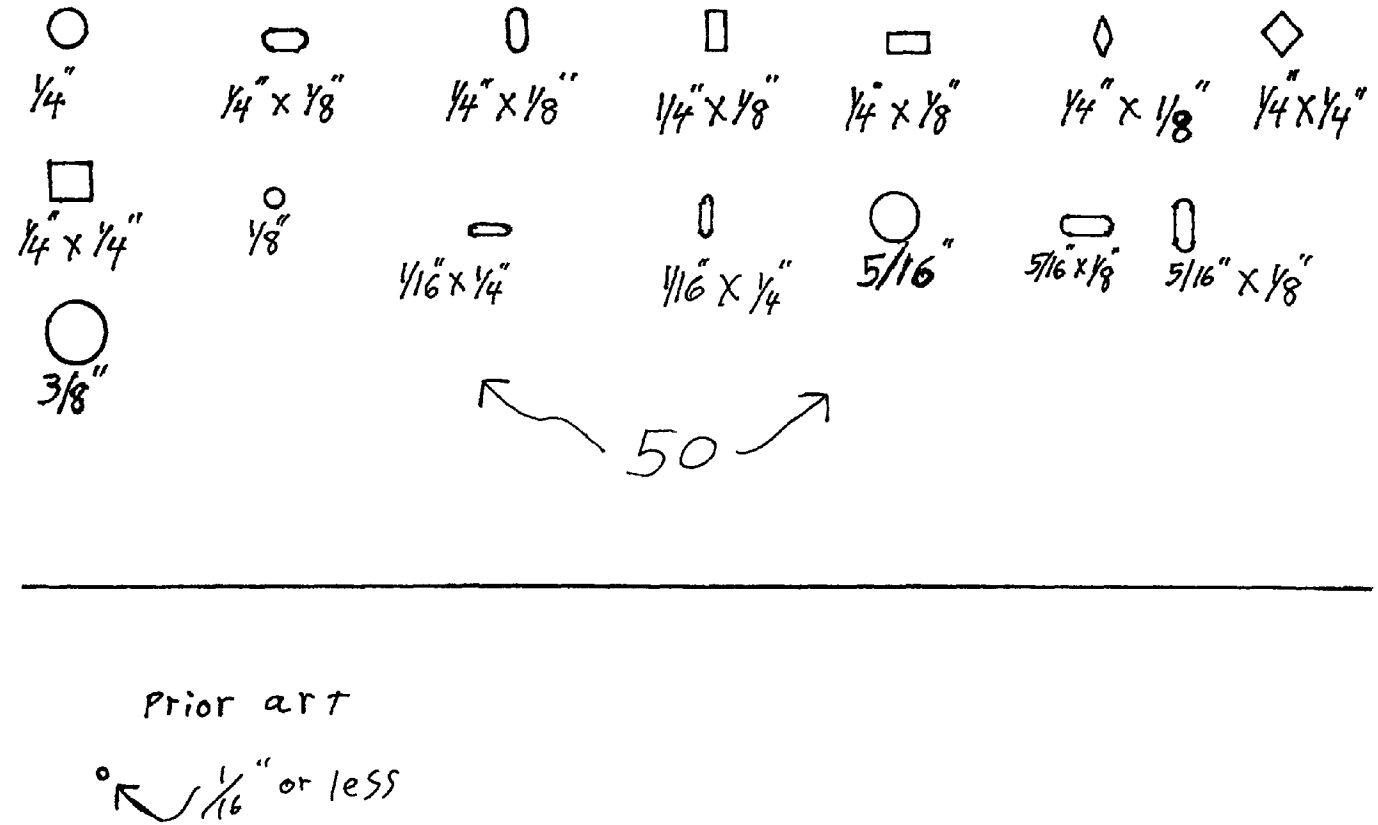
FIG. 30 is a representation of exemplary top views of nozzle inlet openings which may be used on an oscillating tube. An exemplary nozzle inlet opening of a typical prior art oscillating sprinkler is also shown.

In variations, a closed area of a stationary regulatory insert such as the tabs of FIGS. 17, 18, and 23 for example, may vary in longitudinal length or may vary in circumferential length, or may vary in both circumferential and longitudinal length.

Figure 22:
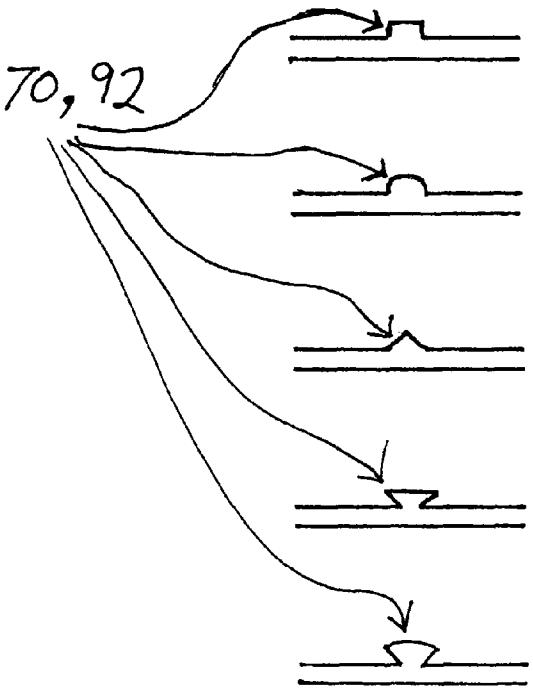
FIG. 22 is a representation of exemplary side views of protrusions which may be used as closed areas on, for example, an inter-flange extension of a stationary regulatory insert.

In variations, a closed area of a stationary regulatory insert such as the protrusions of FIGS. 20 and 22 for example, may vary in longitudinal length or may vary in circumferential length, or may vary in both circumferential and longitudinal length.

The current invention offers many variations and the possible use of many different combinations of components. A manufacturer may choose from many variations and many different possible combinations of components based on economics, ease of manufacturing, ease of assembly, and quality, etc.

Variations include, but are not limited to the following:

Number of nozzles

Longitudinal angle of the nozzles

Diameter, thickness, and length of the oscillating tube

Size, shape, and angular orientation of nozzle inlet openings

Size, shape, and angular orientation of nozzle outlet openings

Size, shape, and location of open areas of stationary regulatory insert

Size, shape, and location of closed areas of stationary regulatory insert

In variations, the total number of degrees of oscillation from the right to left horizontal-most oscillation position may vary. The oscillating tube may oscillate from a basic 45 degrees right to 45 degrees left, for a total of 90 degrees for example. Or it may oscillate fewer degrees, or more degrees, for example, it may oscillate between 40 degrees right and 40 degrees left for a total of 100 degrees.

The current invention may use a relatively very small space between the oscillating tube and the stationary regulatory insert, regardless of whether the stationary regulatory insert is tubular or arcuate, or a combination thereof. Any water and water pressure between the oscillating tube and the stationary regulatory insert may act as a lubricant and conduce relatively friction-free oscillation of the oscillating tube about the stationary regulatory insert. In some variations a stationary regulatory insert comprising two-part slots with closed center sections may be used, regarding for example exemplary nozzles #1 and #13. If such a variation is used, it may be advantageous to place an "O" ring on both sides of two-part slots with closed center sections in order to prevent any horizontal or longitudinal water flow that may occur between the oscillating tube and the stationary regulatory insert from entering the nozzle inlet openings within the select portion of the oscillation cycle wherein the nozzle inlet openings are positioned above closed center sections. Only nozzle inlet openings that are intended to be substantially completely closed within select portions of the oscillation cycle may be affected by any water flow existing between oscillating tube and the stationary regulatory insert. Typically one "O" ring is located at or near each end of the oscillating tube, in variations, it may be advantageous to place a second "O" ring longitudinally medially from the two-part slot with a closed center section as may be seen in FIG. 15, for example. Water flow between the oscillating tube and stationary regulatory insert may function as a lubricant and may not affect any other nozzle inlet openings because no attempt is being made to substantially completely close flow to them anyhow.

Figure 8B:
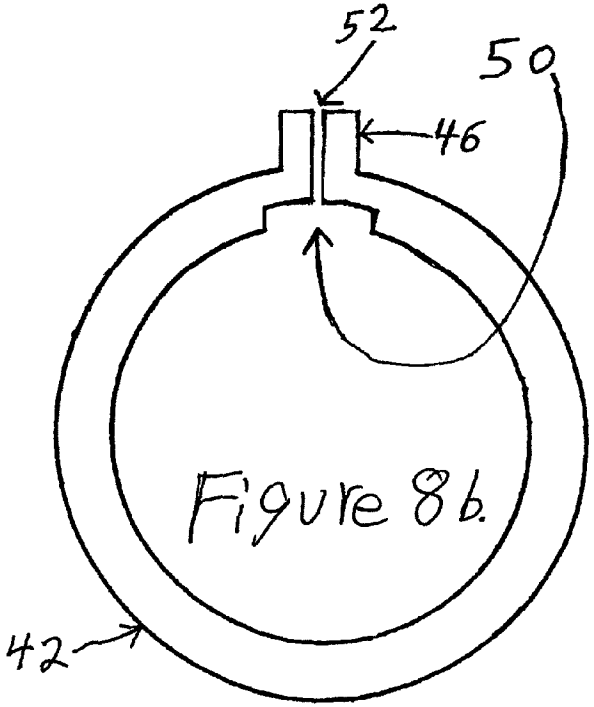
FIG. 8*b* is an exemplary end view of a circumferentially-elongated nozzle inlet opening or a "larger" round nozzle inlet opening on the inner wall of a relatively thick-walled oscillating tube, nozzle, and nozzle outlet opening.
Figure 8A:
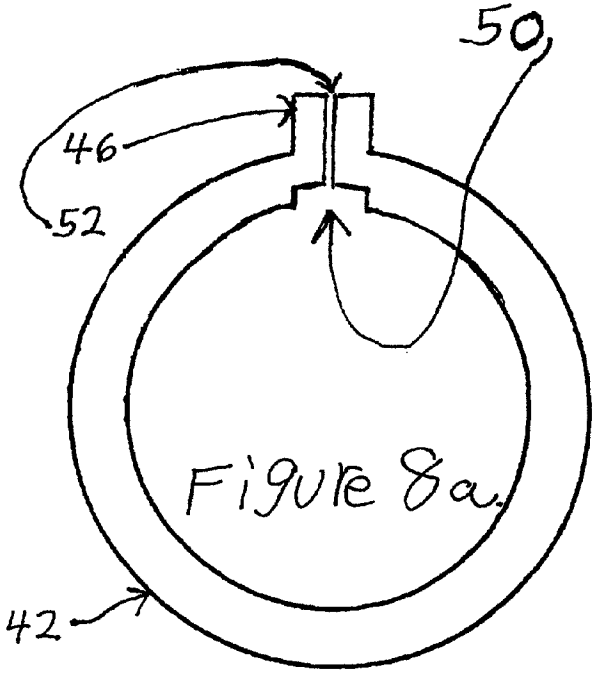
FIG. 8*a* is an exemplary end view of a longitudinally-elongated nozzle inlet opening or a "smaller" round nozzle inlet opening on the inner wall of a relatively thick-walled oscillating tube, nozzle, and nozzle outlet opening.
Figure 8C:
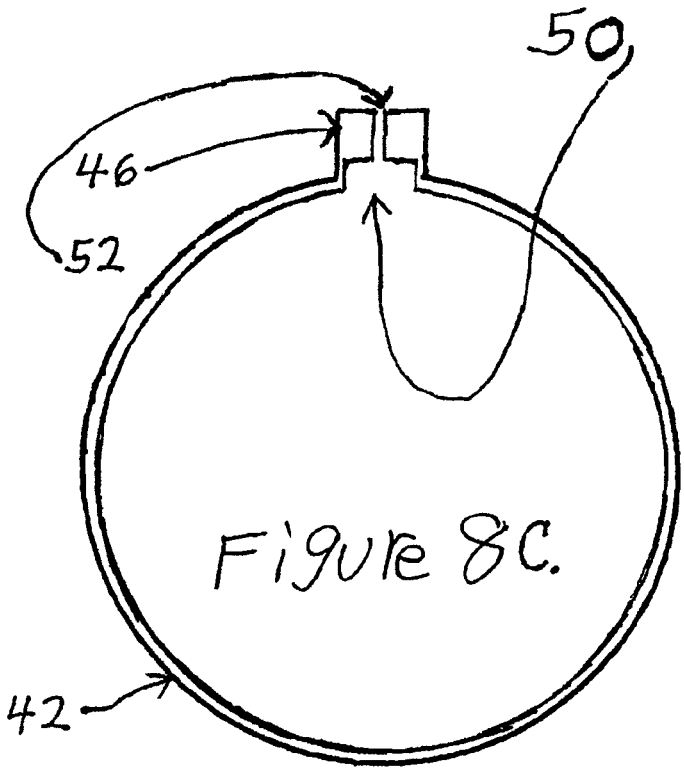
FIG. 8*c* is an exemplary end view of a nozzle inlet opening on the inner wall of a relatively thin-walled oscillating tube and partially contained within its corresponding nozzle.
Figure 9:
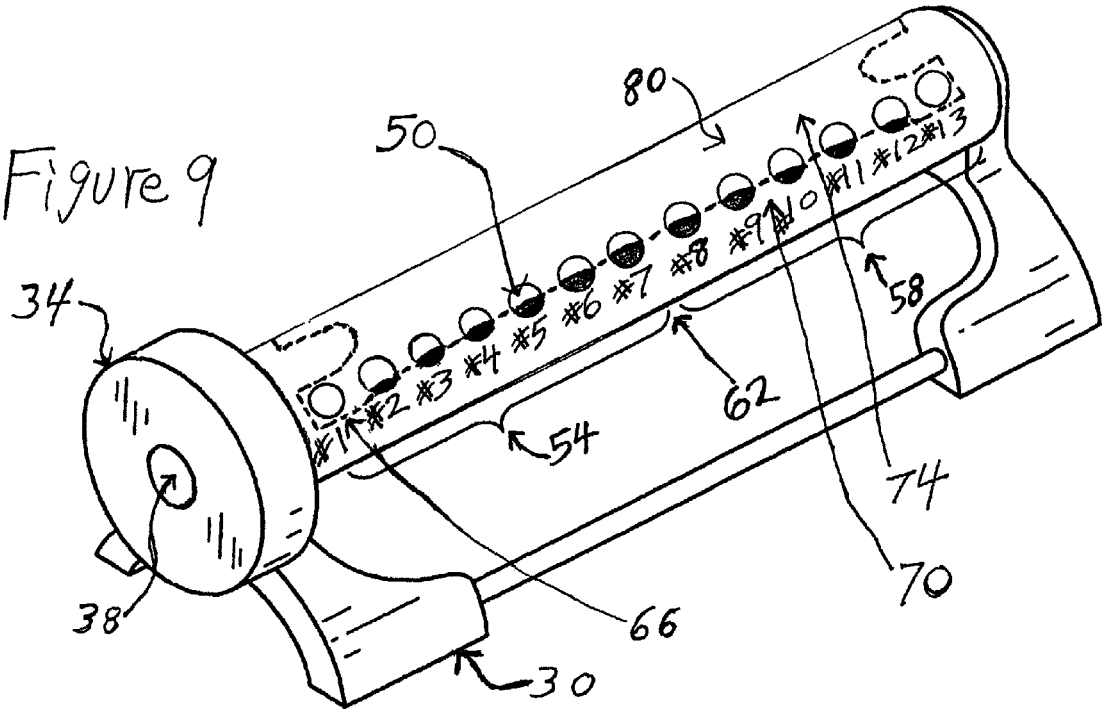
FIG. 9 is an exemplary perspective view of an embodiment of the current invention with the oscillating tube in a horizontal-most oscillating position. Nozzles not shown.
Figure 10:
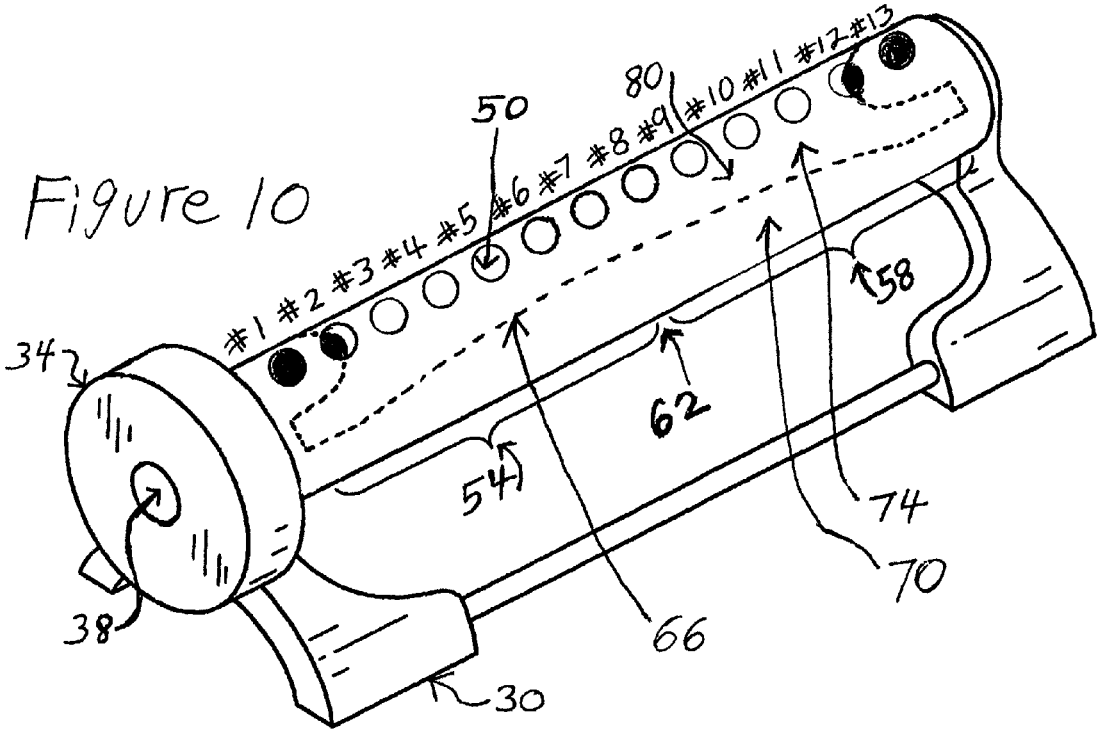
FIG. 10 is an exemplary perspective view of an embodiment of the current invention with the oscillating tube in a vertical oscillating position. Nozzles not shown.

In variations, an embodiment of the current invention may use an oscillating tube with relatively thin walls, thinner than are depicted for example in FIG. 2, FIG. 8*a*, or FIG. 8*b*. In this variation, the "vertical length" or "depth" of each relatively large three-dimensional nozzle inlet opening may extend some distance into the available longitudinal length of its corresponding nozzle, the outside diameter of the nozzle being sufficiently large to contain the nozzle inlet opening, and the relatively small size of the nozzle outlet opening being unaffected, as shown in FIG. 8*c*, for example.

What is claimed is:

1. A system for automatically providing a substantially rectangular fluid distribution pattern, wherein the system comprises:

a regulatory insert, wherein:

the regulatory insert comprises a fluid supply opening configured to receive a fluid supply;

the regulatory insert defines at least one insert-aperture; and the regulatory insert is configured to provide the fluid supply from the fluid supply opening to the at least one insert-aperture;

an oscillating tube, wherein:

the oscillating tube rotates about the regulatory insert; and the oscillating tube defines a plurality of tube-apertures, wherein the plurality of tube-apertures comprises a first tube aperture, and wherein the first tube-aperture is configured to pass over at least one insert-aperture to vary the distance an amount of fluid passing through the first tube-aperture is projected from at least one of the plurality of tube-apertures;

wherein the at least one insert-aperture is configured to:

at either extreme of an oscillation period of the oscillating tube's rotation:

allow a greater flow rate to tube-apertures at opposite ends of the oscillating tube than a flow rate to a tube-aperture in a mid-section of the oscillating tube; and at a central portion of the oscillation period of the oscillating tube's rotation:

allow a lesser flow rate to tube-apertures at opposite ends of the oscillating tube than the flow rate to the tube-aperture in the mid-section of the oscillating tube.

2. The system for automatically providing a substantially rectangular fluid distribution pattern of claim 1, wherein the system further comprises a fluid motor configured to rotate the oscillating tube.

3. The system for automatically providing a substantially rectangular fluid distribution pattern of claim 1, wherein the regulatory insert comprises a stationary regulatory insert.

4. The system for automatically providing a substantially rectangular fluid distribution pattern of claim 1, wherein at least one of the plurality of tube-apertures are characterized by a substantially larger opening proximal to the regulatory insert than an opening distal to the regulatory insert.

5. The system for automatically providing a substantially rectangular fluid distribution pattern of claim 1, wherein the at least one insert-aperture comprises a plurality of insert-apertures.

6. The system for automatically providing a substantially rectangular fluid distribution pattern of claim 1, wherein the at least one insert-aperture comprises at least one insert-aperture configured to allow a greater flow rate to a spatially corresponding tube-aperture than at least one other insert-aperture configured to allow a flow rate to an other spatially corresponding tube-aperture at least one period of time during a rotation of the oscillating tube about the regulatory insert.

7. The system for automatically providing a substantially rectangular fluid distribution pattern of claim 1, wherein the substantially rectangular fluid distribution pattern is characterized by a substantially rectangular perimeter of fluid distribution on a plane under the system.

8. The system for automatically providing a substantially rectangular fluid distribution pattern of claim 1, wherein the regulatory insert comprises an arcuate insert.

9. A method for automatically providing a substantially rectangular fluid distribution pattern, wherein the method comprises:

providing a fluid flow to an oscillating tube, wherein the oscillating tube defines a plurality of tube-apertures along a length of the oscillating tube;

rotating the oscillating tube about an axis substantially parallel to the length of the oscillating tube;

inhibiting the fluid flow to at least one of the plurality of tube-apertures based at least partially on a rotational location of the oscillating tube;

wherein inhibiting the fluid flow to at least one of the plurality of tube-apertures comprises:

at either extreme of an oscillation period of the oscillating tube's rotation:

inhibiting a flow rate to a tube-aperture in a mid-section of the oscillating tube more than to tube-apertures at opposite ends of the oscillating tube; and at a central portion of the oscillation period of the oscillating tube's rotation:

inhibiting a flow rate to tube-apertures at opposite ends of the oscillating tube more than to the tube-aperture in the mid section of the oscillating tube.

10. The method for automatically providing a substantially rectangular fluid distribution pattern of claim 9, wherein rotating the oscillating tube comprises:

providing a fluid motor operably coupled with the oscillating tube; and powering the fluid motor with the fluid flow.

11. The method for automatically providing a substantially rectangular fluid distribution pattern of claim 9, wherein inhibiting the flow to at least one of the plurality of tube-apertures comprises providing a regulatory insert disposed between the oscillating tube and a source of the fluid flow.

12. The method for automatically providing a substantially rectangular fluid distribution pattern of claim 9, wherein inhibiting the flow to at least one of the plurality of tube-apertures comprises rotating the oscillating tube about a regulatory insert disposed between the oscillating tube and a source of the fluid flow.

13. A system for automatically providing a substantially rectangular fluid distribution pattern, wherein the system comprises:

a first means for providing a fluid flow;

a second means for dividing the fluid flow into a plurality of subordinate fluid flows and projecting the plurality of subordinate fluid flows into a plurality of directions, wherein the second means comprises an oscillating tube;

a third means for rotating the second means; and a fourth means for selectively inhibiting the fluid flow from the first means to each of the subordinate fluid flows;

wherein at either extreme of an oscillation period of the oscillating tube's rotation, the fourth means inhibits a flow rate to a subordinate fluid flow in a mid-section of the oscillating tube more than to subordinate fluid flows at opposite ends of the oscillating tube;

and wherein at a central portion of the oscillation period of the oscillating tube's rotation, the fourth means inhibits a flow rate to subordinate fluid flows at opposite ends of the oscillating tube more than to the subordinate fluid flow in the mid section of the oscillating tube.

14. The system for automatically providing a substantially rectangular fluid distribution pattern of claim 13, wherein the first means comprises fluid flow supply.

15. The system for automatically providing a substantially rectangular fluid distribution pattern of claim 13, wherein the third means comprises a fluid motor.

16. The system for automatically providing a substantially rectangular fluid distribution pattern of claim 13, wherein the fourth means comprises a regulatory insert.

* * * * *